US011454471B1

(12) United States Patent
Pittman et al.

(10) Patent No.: US 11,454,471 B1
(45) Date of Patent: Sep. 27, 2022

(54) FIRE CONTROL LOCKOUT ASSEMBLY FOR SEMIAUTOMATIC FIREARMS PROVIDING SINGLE SHOT OPERATION THEREOF

(71) Applicants: Earl Leonard Pittman, Fresno, CA (US); Paul Christian Dickie, Clovis, CA (US)

(72) Inventors: Earl Leonard Pittman, Fresno, CA (US); Paul Christian Dickie, Clovis, CA (US)

(73) Assignee: Kunvirt Firearms Inc., Clovis, CA (US)

( * ) Notice: Subject to any disclaimer, the term of this patent is extended or adjusted under 35 U.S.C. 154(b) by 0 days.

(21) Appl. No.: 17/384,316

(22) Filed: Jul. 23, 2021

Related U.S. Application Data

(60) Provisional application No. 63/170,200, filed on Apr. 2, 2021, provisional application No. 63/092,454, filed on Oct. 15, 2020.

(51) Int. Cl.
*F41A 19/45* (2006.01)

(52) U.S. Cl.
CPC ..... *F41A 19/45* (2013.01)

(58) Field of Classification Search
CPC ..... F41A 19/45; F41A 19/46
See application file for complete search history.

(56) References Cited

U.S. PATENT DOCUMENTS

| | | | | |
|---|---|---|---|---|
| 3,155,004 | A * | 11/1964 | Jennie | F41A 9/52 89/128 |
| 7,421,937 | B1 * | 9/2008 | Gangl | F41A 19/16 89/142 |
| 8,276,502 | B1 | 10/2012 | Wright | |
| 8,667,881 | B1 * | 3/2014 | Hawbaker | F41A 19/45 42/69.01 |
| 8,756,847 | B2 | 6/2014 | Huther | |
| 8,820,211 | B1 | 9/2014 | Hawbaker | |
| 9,733,034 | B1 | 8/2017 | Viani | |

(Continued)

OTHER PUBLICATIONS

KaliKey Bolt Action AR, Home Page, Internet, downloaded Jul. 23, 2021, U.S.

(Continued)

*Primary Examiner* — Gabriel J. Klein
(74) *Attorney, Agent, or Firm* — Richard A. Ryan

(57) ABSTRACT

A fire control lockout assembly restricts a semiautomatic style firearm to single shot operation by requiring specific, sequential manual manipulation of the firearm by the operator prior to firing a subsequent round from the firearm. The lockout assembly has a modified safety selector and a modified disconnector and/or a modified trigger assembly that interrupts the usual automatic progression of the fire control group components after firing the firearm by increasing the upward distance the trigger sear must travel before contacting the disconnector. The increased distance prevents the hammer from automatically being released from the disconnector. The modified safety selector has a barrel that presses downward on the rearward end of the disconnector to release the hammer. After firing a round, the safety selector must be moved to its safe position and then to its fire position in order to fire a subsequent round from the firearm.

20 Claims, 17 Drawing Sheets

(56) References Cited

U.S. PATENT DOCUMENTS

| | | | | |
|---|---|---|---|---|
| 9,952,012 | B2 * | 4/2018 | Fellows | F41A 19/14 |
| 10,330,413 | B2 | 6/2019 | Williams et al. | |
| 10,670,367 | B1 | 6/2020 | Boyer et al. | |
| 10,746,489 | B1 | 8/2020 | Huang | |
| 10,935,337 | B2 | 3/2021 | Delgado Acarreta et al. | |
| 11,015,893 | B2 * | 5/2021 | Robinson | F41A 17/42 |
| 2014/0260942 | A1 * | 9/2014 | Talasco | F41A 19/46<br>89/129.01 |
| 2014/0311004 | A1 * | 10/2014 | Barrett | F41A 17/42<br>42/16 |
| 2014/0366418 | A1 * | 12/2014 | Stakes | F41A 19/10<br>42/69.03 |
| 2015/0068090 | A1 * | 3/2015 | Christensen | F41A 17/46<br>42/69.01 |
| 2016/0084599 | A1 | 3/2016 | Alicea, Jr. | |
| 2016/0161202 | A1 * | 6/2016 | Larue | F41A 19/45<br>42/69.01 |
| 2018/0100714 | A1 * | 4/2018 | Borders | F41A 3/72 |
| 2018/0259282 | A1 * | 9/2018 | Tolentino | F41A 9/70 |
| 2020/0182575 | A1 * | 6/2020 | Barrett | F41A 17/52 |
| 2020/0292266 | A1 * | 9/2020 | Underwood | F41A 19/25 |

OTHER PUBLICATIONS

KaliKey Bolt Action AR, Install Page, Internet, downloaed Jul. 23, 2021, U.S.

* cited by examiner

FIRE CONTROL LOCKOUT ASSEMBLY FOR SEMIAUTOMATIC FIREARMS PROVIDING SINGLE SHOT OPERATION THEREOF

CROSS-REFERENCE TO RELATED APPLICATIONS

This patent application is a claims priority to U.S. Provisional Patent Application Ser. No. 63/170,200 filed Apr. 2, 2021 and to U.S. Provisional Patent Application Ser. No. 63/092,454 filed Oct. 15, 2020.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to the operation of the trigger, disconnector and safety selector assemblies of a AR-15 type firearm. In particular, the present invention relates to components and assemblies which are utilized to convert a semiautomatic AR-15 type firearm from a semiautomatic firing capability to a single shot action type firearm. Even more particularly, the present invention relates to such components and assemblies that operate to lockout the firearm's fire control system preventing a round from discharging once a single round has been loaded into the firing chamber or discharged from the firearm until the operator makes certain hand movements to return the fire control system back to its firing position to fire another round.

B. Background

Firearms are utilized for many purposes, including target shooting, hunting, self-defense and police/military action. Although there is a wide range of different types and models of firearms, firearms can be generally categorized as either a handgun, shotgun or rifle. Certain components are common to all such firearms, including an ammunition storage compartment for storing the shells or bullets (hereinafter, collectively referred to as "rounds") which are to be shot out of the firearm, a receiver which receives a round from the storage compartment, a firing mechanism for engaging the round to fire the round from the firearm, a barrel for directing the fired round in the desired direction and one or more operator support components that are configured for the operator to safely, comfortably and effectively hold or otherwise support the firearm while he or she operates (fires) the firearm. The ammunition storage compartment comprises a chamber located inside the firearm, in a removable or fixed magazine or clip or, for certain types of handguns (i.e., a revolver), in a cylinder that rotates relative to the barrel. The receiver receives a single round from the ammunition storage compartment and places the round in position to be acted upon by the firing mechanism. The typical firing mechanism comprises a trigger that causes a firing pin to be driven into the round in a manner that discharges the round from the firearm through the barrel. For hand guns, the support component is a pistol grip that the operator grips with his or her hand. For shotguns and rifles, one of the typical support components comprises a rearwardly positioned stock that has a rearward end which is generally positioned against the operator's shoulder when operating the firearm. As well known to persons who are skilled in the art, some shotguns and rifles have a handgun-type pistol grip either instead of or in addition to the stock to provide additional operator support while he or she is operating the firearm.

Historically, firearms were generally only capable of firing one round for each operation of the firing mechanism, thereby requiring the operator of the firearm to completely cycle the firing mechanism (i.e, operating a bolt action mechanism) after firing a round prior to being able to fire a subsequent round from the firearm. Such operation is commonly referred to as single shot operation. Semiautomatic weapons are configured to allow subsequent rounds to be fired from the firearm by only pulling the trigger, as opposed to a full cycling of the firing mechanism, for each round to be fired from the firearm. Automatic weapons are configured such that a single pull of the trigger will fire rounds from the firearm as long as there are rounds in the storage compartment. The present invention is related to being able to convert certain semiautomatic firearms, namely an AR-15 type rifle, to a single shot operation.

Semiautomatic weapons typically utilize gas, blow-forward, blowback or recoil energy to eject a spent cartridge of a round after the firearm is fired and the round is directed down the barrel, chamber a new round from the magazine or other storage compartment, and resetting the firing mechanism. This resetting enables another round to be fired once the trigger is pulled again. The rounds from a semiautomatic rifle, which are typically stored in and fed into the firing chamber from an external magazine, was a successor to earlier rifles that required manual cycling of the firing mechanism after each round was shot, such as is utilized for bolt-action and repeating rifles. As is readily appreciated by persons skilled in the art, the ability to load a subsequent round without manually recycling the firing mechanism results in an increase in the number of rounds per minute the operator is able to fire from the semiautomatic firearm.

For gas-operated semiautomatic rifles, when a round is fired by the firearm, gas from the cartridges propellant forces the bullet forward and out through the forward end of the barrel. A portion of the gas from the discharged round enters a gas port in the upper part of the barrel. The gas port directs the diverted gas into a gas tube, which then directs this gas into a cylinder located between the firearm's bolt carrier and bolt to drive the bolt carrier rearward to eject the empty cartridge from the cartridge chamber. The rearward movement of the bolt carrier is directed against a buffer assembly to compress an action spring inside a receiver extension tube associated with the receiver. When the rearward end of the buffer assembly reaches its rearmost position inside the receiver extension tube, the compressed action spring expands forward to drive the buffer assembly forward. The forward movement of the buffer assembly drives the bolt carrier forward to chamber the next round from the firearm's magazine and place the firearm in condition to fire this next round.

The standard AR-15 rifle, a prior art drawing of the components thereof is shown in FIG. 1, is comprised of a system where a small part of the hot gases which propel a round out of the barrel is diverted from the barrel and is directed to a bolt carrier group (also referred to as the "BCG") without the use of any intervening mechanisms. An AR-15 rifle fires from a locked bolt, meaning that when a cartridge is chambered, a bolt closes behind the cartridge case and rotates fifteen degrees so lugs located on the bolt head will engage protrusions on the interior of the barrel extension, which solidly locks the bolt in place behind the cartridge so the bolt can withstand the high pressure forces produced by powder combustion resulting from firing a round. When the round is fired, the bolt needs to rotate in the opposite direction and be payload, so the spent cartridge case can be ejected from the firearm and a new round from the magazine can be chambered in the firearm's receiver. As soon as the bullet passes the gas port in the barrel, a portion of the hot gases flow into the gas tube towards the BCG. The gas enters an expansion chamber through a bolt carrier key and exert pressure on all surfaces of the expansion chamber. The forward surface of the expansion chamber is the piston in the bolt tail, having three sealing "C" rings. The spent gas from cartridge pushes on the piston to move the cylinder from its stationary position to push the bolt carrier rearward.

During this action of the rifle two things happen. First, the rearward travel of the bolt carrier causes a pair of holes that are drilled on the side of the bolt carrier to move past the sealing C rings on the tail of the bolt and, as a result, to vent the hot gases from the cartridge combustion. Second, as the bolt carrier continues to move backwards due to inertia, a cam slot which is milled into the top side of the bolt carrier acts on the bolt lug, forcing the bolt to rotate into its unlocked position. By this time, the bullet has left the barrel and the pressure has dropped to safe levels. As the bolt carrier continues its rearward movement, due to inertia, the bolt is pulled back from the breech and the spent cartridge case is ejected from the firearm. The recoil spring, which has been compressed by the rearward movement of the BCG, pushes the bolt carrier forward again, pulling a fresh cartridge from the magazine, chambering it in the receiver and, through interaction of the cam slot and bolt lug, the bolt is rotated back into its locked position. This arrangement allows not only an in-axis action, but also moving parts that possess a low mass, keeping shaking to a minimum.

The firing of the semiautomatic rifle and the movement of the BCG is initiated by the operator firing the rifle, which is initiated by the operator squeezing the trigger, so as to pull it rearward, by his or her finger. The trigger is part of the rifle's fire control group, which also includes the hammer, sear, disconnector and various springs and pins. When the trigger is pulled, the movement of the trigger releases the hammer from the lower sear so the hammer will rotate upward and strike the firing pin to discharge the round. The rearward movement of the BCG described above pushes the hammer back into the disconnector where the hook-shaped sear of the hammer is captured by the top hook sear of the disconnector, which happens so fast that the operator still has the trigger pulled. When the operator releases the trigger, the trigger spring rotates the trigger assembly to its firing position. As the trigger assembly is rotating back to its firing position, the front sear of the trigger assembly pushes the disconnector upward to cause the disconnector to rotate about the trigger pin and allow the disconnector to release the hammer top sear from the disconnector top hook sear. The hammer rotates back toward the firing pin where the hammer lower sear is captured by the trigger sear, placing the rifle back in the ready-to-fire position. With the safety selector switch still in the fire position, the rifle can be fired by squeezing the trigger.

As stated above, semiautomatic rifles such as the AR-15 style rifle are very popular for target shooting and home defense. The popularity of this firearm is due in part to the semiautomatic of the firing mechanism, which allows for rapidly firing a high number of rounds over a relatively short period of time, and the ability for the owner or operator of the firearm to customize these rifles with the addition of one or more of a wide variety of alternative or additive components. For instance, the operator can customize an AR-15 style rifle with a handguard, mounting or tactical rails disposed around the handguard and one or more accessories that mount to these rails, including accessories such as scopes, tactical lights, laser sight lights, night vision equipment, fore grips, bipods and bayonets. An AR-15 style rifle can also be modified with regard to the type and configuration of the stock (i.e., telescoping and folding stocks) or the addition of a hand or pistol grip below the receiver, hand rips below the barrel, flash suppressors and the like.

Unfortunately, the very features that are generally considered benefits of an AR-15 style rifle also create potential safety and legal issues for these rifles. With regard to safety, the semiautomatic nature of the AR-15 style rifle can result in unintentional firing of the firearm due to the ease of being able to fire multiple rounds by merely repeatedly pulling on the firearm's trigger. If an AR-15 style rifle did not have this semiautomatic operation, the firearm would tend to be safer. With regard to legal issues, the use of certain of the above accessories to a stock AR-15 style rifle can run afoul of laws pertaining to bans on assault rifles. For instance, California and New York have defined, at least in part, an assault rifle as being a semiautomatic rifle having one or more of certain the accessories and which use detachable magazines, or which utilize magazines exceeding a certain capacity and/or which are less than a specified length. Other states have similar laws. Generally, the laws banning assault rifles are directed to the semiautomatic rifles that which have or which are modified to have accessories that, by the definition, make them an assault rifle. One way to avoid the issues with the laws prohibiting assault rifles, would be beneficial to remove an AR-15 style rifle from the definition of a semiautomatic weapon by not allowing repeated firing of the firearm with just repeated pulling of the trigger. If the AR-15 style rifle was not a semiautomatic rifle, the use or addition of any of the desired accessories with an AR-15 style rifle would, by default, not result in the firearm being an assault weapon.

There have been attempts to modify an AR-15 style rifle to remove the ability of the firearm to be utilized in a semiautomatic manner. One such example is the Kali Key®, which is a registered trademark of Boltar, LLC. The Kali Key® is a replacement gas key for a stock AR-15 style rifle's bolt carrier group that converts the firearm from a semiautomatic operation to a bolt action operation. When the Kali Key® is inserted into the bolt carrier group, it blocks the gasses that would otherwise trigger the semiautomatic cycling of the rifle. The device works by diverting the gasses that would normally be split off toward the bolt carrier group to outside the ejection port. Instead of having diverted gas that moves the bolt carrier rearward, the operator pulls the handle of the Kali Key® rearward for the single shot bolt action operation. The Kali Key® is marketed as a device to allow use of the various accessories and other configurations or modifications to an AR-15 style rifle that would otherwise result in the firearm being classified, and commonly banned, as an assault weapon.

Various other prior art devices, including some which are patented, are directed to modifications to the firing mechanism of an AR-15 style rifle. Some of these are directed to dual mode trigger devices that allow the firearm to fire when the trigger moves in both the rearward and forward direction, to devices that modify how the firearm's safety mechanism is configured or operate and to devices which secures the firearm in a non-firing condition. What is needed, therefore, is a device for limiting a semiautomatic firearm, such as a AR-15 or AK47 style rifle, to single shot operation. The improved device should be sized and configured to fit within the interior of the firearm and operate with the firearm's firing mechanism in a manner which prevents automatic cycling of the firing mechanism so additional action is required by the operator of the firearm than just pulling the firearm's trigger to fire a subsequent round from the rifle. Once installed, the device should result in the firearm no longer being a semiautomatic rifle, due to it's inability to operate in a semiautomatic mode, so as to achieve the safety and legal benefits associated with single shot, non-semiautomatic rifles. The new device should allow the owner of the firearm to utilize any of the numerous accessories that are available for typical semiautomatic firearms without the firearm being considered an assault weapon for purposes of laws banning assault weapons. The device should be durable so as to not be damaged by firing of the firearm over a sustained or extended period of time. Preferably, the new device should be configured in a manner which allows the operator to easily and quickly install the device within the firing mechanism of the firearm. It is also preferred that, although not allowing a firearm to be utilized in a semiautomatic mode, the device should be relatively easy to use when operating the firearm and be suitable for being economically manufactured so that it may be made widely available for use.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as "including", "comprising" or "having" and variations thereof herein is meant to encompass the items listed thereafter and equivalents thereof. The terms "a" and "an" herein do not denote a limitation of quantity, but rather denote the presence of at least one of the referenced items. Further, the use of terms "first", "second", and "third", and the like, herein do not denote any order, quantity, or importance, but rather are used to distinguish one element or feature of an element from another. The term "and/or," when used herein with a list of two or more items, means that any one of the listed items can be employed by itself, or any combination of two or more of the listed items can be employed.

The new fire control lockout assembly for semiautomatic firearms of the present invention provides the various benefits and solves the problems that are identified above. That is to say, the present invention is directed to a fire control lockout assembly for use with semiautomatic firearms, such as AR-15 or AK47 style rifles, that is structured and arranged to be placed within the firearm's lower receiver and operate with the standard firing mechanism of the firearm to prevent the automatic cycling of the firearm's firing mechanism. Once installed, the new fire control lockout assembly results in the semiautomatic firearm no longer being able to operate in a semiautomatic mode, which will achieve the safety and legal benefits associated with single shot, non-semiautomatic rifles. Specifically, once the fire control lockout assembly is installed in the firing mechanism of a semiautomatic firearm, the new fire control lockout assembly will require additional manual action by the operator in order to fire a subsequent round from the firearm, thereby making the firearm no longer able to operate as a semiautomatic firearm. As such, the new fire control lockout assembly allows the owner of AR-15 or AK47 style rifles, as well as other semiautomatic firearms, to utilize any of the numerous, widely available accessories for such firearms without the firearm being considered an assault weapon for purposes of laws which ban assault weapons due to the firearm no longer being characterized as a semiautomatic rifle. In the preferred embodiments of the present invention, the new fire control lockout assembly is durable so as to not be damaged by repeated firing of the firearm over a sustained or extended period of time, as is common for such firearms. Also in the preferred embodiments, the present invention is structured and arranged in a manner to allow the operator to easily and quickly install the fire control lockout assembly in the firing mechanism of the firearm to convert the firearm's semiautomatic operation to single shot operation. Although the new assembly does not allow a firearm to be used in a semiautomatic mode, the assembly nevertheless results in the firearm to be relatively easy to use when the operator desires to fire subsequent rounds from the firearm. In the preferred configurations of the present invention, the fire control lockout assembly is suitable for being economically manufactured so that the device may be made widely available for use.

The new fire control lockout assembly for semiautomatic firearms is utilized with the fire control group of the firearm's firing mechanism. As well known by persons who are skilled in the relevant art, the fire control group comprises a disconnector, trigger, sear, hammer and hook that operate together to engage the firing pin on a round after the operator pulls the trigger. As set forth herein in the Background, normally the firing mechanism is configured such that once the trigger is pulled and the round is fired, a portion of the gas from firing the round is directed to bolt carrier group to push the bolt rearward, eject the cartridge from the firearm and allow a new round from the magazine to move into position for firing. All of this happens automatically merely upon the operator pulling the trigger. The new fire control lockout assembly utilizes a modified disconnector that is configured such that when the trigger sear of the firing mechanism moves back into position after a round has been fired, the trigger sear can no longer move the disconnector enough to disengage the hook of the disconnector from the hook of the hammer. Because the disconnector is not able to be contacted by the trigger sear and, therefore, move so it can slide off the hammer hook, the disconnector remains in its position holding the hammer, effectively keeping the firearm from firing a subsequent round without intervention by the operator. The firearm's safety selector is also modified to include a protrusion that extends towards the disconnector. This new protrusion comes in contact with the rear of the disconnector when the safety selector is rotated to the safe position. During this operation, the protrusion pushes down on the rear of the disconnector causing the front hook of the disconnector to slide off the hammer hook which allows the hammer to rotate to the ready position where the trigger sear now is holding hammer in the cocked position. The selector switch can then be moved to the fire position to fire another round.

The benefit of the new fire control lockout assembly of the present invention, with the modified disconnector and selector switch components, is that the semiautomatic action of an AR-15 or AK47 style rifle, or the like, is interrupted at the fire control group when a round has been fired. When firing a round with the new assembly, the disconnector cannot be moved enough by the trigger assembly as it returns to its normal fire ready position. The inability for the sear at the front of the trigger to move the disconnector enough to slide the disconnector hook off the hammer hook interrupts the action of the firearm's fire control group. This limiting of the action of the fire control group prevents or converts a semiautomatic firearm, such as AR-15 or AK47 style rifles, into a single shot firearm. As a single shot firearm, the operator is only able to fire the firearm again by returning the firearm to its safe position by manually rotating the fire selector switch back to the safe position and then rotating the selector switch back to its fire position, which provides a two-step manual interrupt to what would otherwise automatically occur during semiautomatic operation of the firearm.

Accordingly, the primary object of the present invention is to provide a new fire control lockout assembly for semiautomatic firearms that has the various advantages discussed above and elsewhere in the present disclosure and, when utilized with a semiautomatic firearm, overcomes the various disadvantages and limitations that are associated with presently available apparatuses and systems for converting a semiautomatic firearm to single shot operation.

It is an important objective of the present invention to provide a new fire control lockout assembly for firearms which, when utilized with a firearm, is structured and arranged to prevent the firearm from being able to be operated in a semiautomatic mode so as to provide the safety and legal benefits associated with single shot, non-semiautomatic firearms.

It is also an important objective of the present invention to provide a new fire control lockout assembly for firearms which is sized and configured to fit within the lower receiver of and operate with the various components of the firing mechanism of a semiautomatic firearm to prevent engagement of a subsequent round without specific manual action by the operator of the firearm.

An important aspect of the present invention is that it provides a fire control lockout assembly for semiautomatic firearms which achieves the goals of the above-described objectives.

Another important aspect of the present invention is that it provides a new fire control lockout assembly for semiautomatic firearms which is structured and arranged to be utilized with a firearm's firing mechanism to prevent the firearm from operating in its normal semiautomatic mode.

Another important aspect of the present invention is that it provides a new fire control lockout assembly for a semiautomatic firearm which is structured and arranged to relatively easily and effectively convert the firearm to single shot operation so as to achieve the safety and legal benefits associated with single shot, non-semiautomatic firearms, including utilization of the numerous, widely available accessories for firearms such as AR-15 and AK47 style rifles, without the firearm being considered an assault weapon.

Another important aspect of the present invention is that it provides a new fire control lockout assembly for semiautomatic firearms which has a modified disconnector or trigger assembly that is configured to prevent the firearm from firing a subsequent round without manual intervention by the operator of the firearm by preventing the trigger sear from moving the disconnector enough to disengage the hammer from the disconnector.

Another important aspect of the present invention is that it provides a new fire control lockout assembly for semiautomatic firearms which comprises a modified safety selector that has a protrusion contacting the disconnector when the safety selector is rotated to its safe position, thereby allowing the hammer of the firing mechanism to move to its ready position and be ready to fire when the safety selector is moved to its fire position.

Another important aspect of the present invention is that it provides a new fire control lockout assembly for semiautomatic firearms which is structured and arranged as a conversion mechanism to allow a person to easily and quickly install the assembly in the firing mechanism of a semiautomatic firearm to convert the semiautomatic operation thereof to single shot operation or to be utilized with a new firearm having the new fire control lockout assembly.

Yet another important aspect of the present invention is that it provides a new fire control lockout assembly for semiautomatic firearms which is relatively easy to use, readily adaptable to a variety of different types of semiautomatic firearms and relatively inexpensive to manufacture.

As will be explained in greater detail by reference to the attached figures and the description of the preferred embodiments which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. As will be readily understood and appreciated, the scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
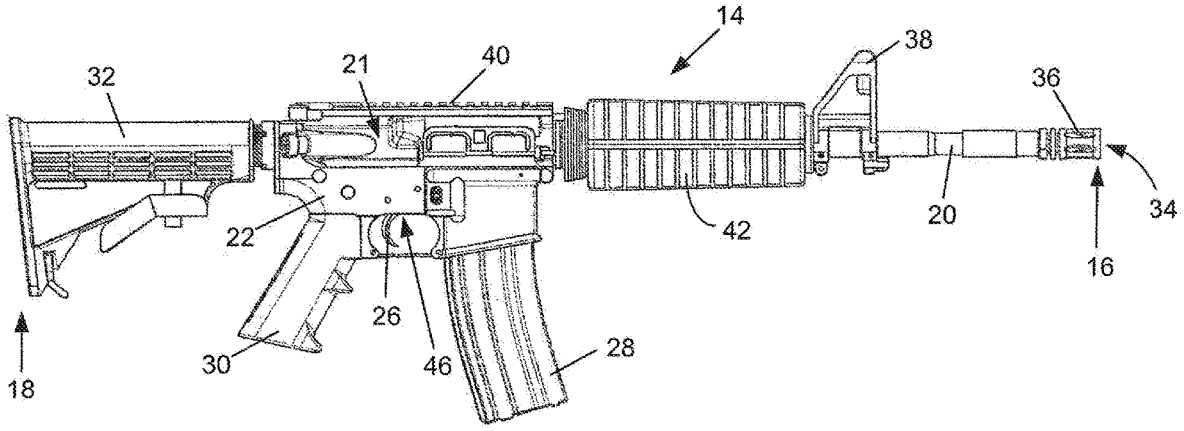
FIG. 1 (PRIOR ART)
FIG. 1 is a right side view of a prior art AR-15 style firearm showing the primary components thereof.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular configurations for the new fire control lockout assembly of the present invention, including the firing mechanism components associated therewith, and the firearm which the new fire control lockout assembly is utilized, persons who are skilled in the relevant art will readily appreciate that the present invention is not so limited. In addition, the exemplary embodiments of the present device are shown and described with only those components which are required to disclose the present invention. Many of the necessary components for manufacturing and using the present invention are not shown in the drawings or necessarily described below, but which are well known to persons who are skilled in the relevant art. As will be readily appreciated by such persons, the various elements of the present invention that are described below may take on any form consistent with forms which are readily realized by one of ordinary skill in the art having knowledge of semiautomatic firearms and the firing mechanisms which are utilize therewith.

Figure 7:
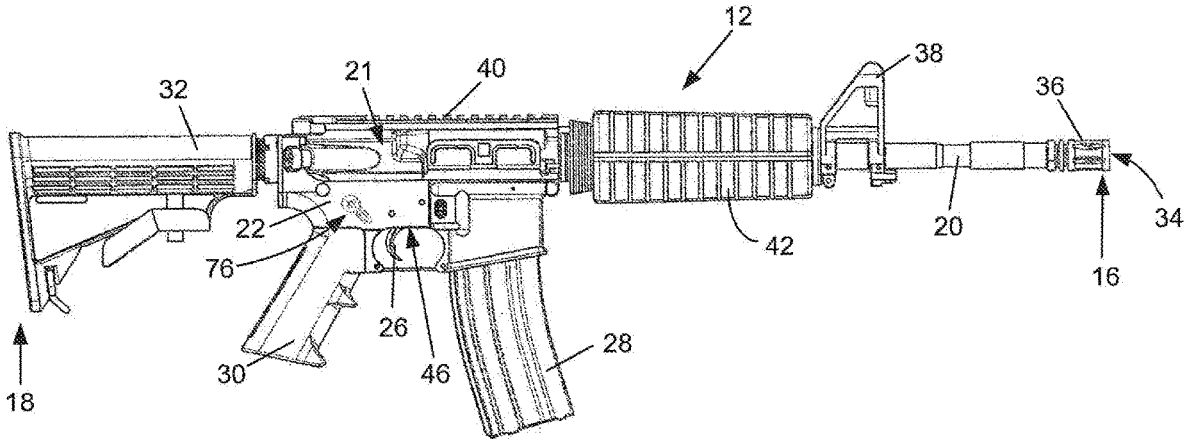
FIG. 7 is a right side view of a AR-15 style firearm having a fire control group and fire selector that are configured according to a preferred embodiment of the present invention to provide single shot operation thereof.

A new fire control lockout assembly that is configured pursuant to one of the preferred embodiments of the present invention is shown generally as 10 in FIGS. 9-12 and 14-16 and 19-25. An exemplary firearm having the new fire control lockout assembly that is configured pursuant to one of the preferred embodiments of the present invention is shown generally as 12 in FIG. 7. As shown in these figures and set forth in more detail below, the new fire control lockout assembly 10 of the present invention is structured and arranged to be incorporated into and utilized with a prior art firearm 14 to form the firearm 12. Both of the firearms shown in FIGS. 1 and 7 are AR-15 style rifles. This specific type of firearm is utilized herein for purposes of describing the various components, features and use of the new fire control lockout assembly 10 of the present invention. As such, the firearms 12 and 14 shown in FIGS. 1 and 7 are presented herein for exemplary purposes and, as such, the present invention is not limited to use with an AR-15 or other similar designed firearms. Persons who are skilled in the art, will readily appreciate that the fire control lockout assembly 10 can be utilized, being modified as may be necessary, with a variety of other firearms, including AK-47 style of rifles or similar rifles and firearms that can benefit from use of the fire control lockout assembly 10 of the present invention.

As set forth above, the fire control lockout assembly 10 (also referred to herein as the "lockout assembly 10") of the present invention is structured and arranged to be incorporated in and utilized with a prior art firearm 12 or a new firearm 14, such as the type shown in FIGS. 1 and 7, having a first or forward end 16, a second or rearward end 18, a barrel 20 generally at the first/forward end 18 of the firearm 12/14, an upper receiver 21 operatively connected to and located generally rearward of the barrel 20, a lower receiver 22 immediately below the upper receiver 21, a fire control group 24 (best shown in FIG. 3) that is operatively disposed in and connected to the lower receiver 22, which includes a trigger 26. The prior art firearm 14 of FIG. 1 also includes a clip, magazine or other storage apparatus 28 for storing a quantity of rounds (i.e., ammunition, which for a rifle typically comprises a cartridge and a projectile) that are directed into the lower receiver 22 and so the projectile can be fired from the barrel 20 at the first/forward end 16 of the firearm 12/14 by the operator's operation (i.e., squeezing) of the trigger 26, a pistol grip 30 that is commonly mounted to the lower side of the lower receiver 22 rearward of the trigger 26, and a buttstock 32 that extends rearward of the upper receiver 21 so the second/rearward end 18 of the firearm 12/14 can be placed against the operator's shoulder while he or she is shooting the firearm 12/14. A typical barrel 20 has a threaded section at the second/forward end 18 of the firearm 14 that defines a muzzle 34, to which may be attached a compensator 36 of the like, through which the bullet or other fired projectile exits the first/forward end 16 of firearm 14 upon operation of the trigger 26. The firearms 12/14 of FIGS. 1 and 7 also have a forward sight 38 toward the first/forward end 18 of the firearm 12/14 and a mounting rail 40 that is mounted to the upper side of the upper receiver 22. Frequently, a telescopic or laser sight is mounted to the mounting rail 40. Another common accessory for these types of firearms 12/14 is a handguard 42 that will generally, but typically not fully, encircles the barrel 18 of the firearm 14 from at or near a forward end of the upper receiver 22 to at or near the first/forward end 16 of the firearm 12/14, as shown in FIGS. 1 and 7.

For purposes of describing the use and relative location of the various components of the new lockout assembly 10 and the firearm 12 of the present invention and the use thereof, the terms "front", "forward","forwardly" and the like are utilized to refer to the direction of the muzzle 34 and the direction in which the new firearm 12 or prior art firearm 14 is aimed when the operator is firing a bullet or other projectile from the firearm 12/14, the terms "back", "rearward", "rearwardly" and the like are utilized to refer to the direction of facing away from the muzzle 34 and the direction of or toward the buttstock 32 of the firearm 12/14 during use of the firearm 12/14. The directions "left", "leftward", "right", "rightward" and the like refer to a direction that is to the left or right side of the firearm 12/14 when viewed from the perspective of the shooter while he or she is holding the buttstock 32 against his or her shoulder and looking in the direction of the muzzle 34 during use of the firearm 12/14. Likewise, the various terms "upward", "upwardly", "upper", "top" and the terms "downward", "downwardly", "lower", "bottom" and the like refer to the direction of the components of the firearm 12/14 when the firearm 12/14 is held during normal use thereof, which is also, respectively, the top and bottom of the page in FIGS. 1 and 7.

Figure 2:
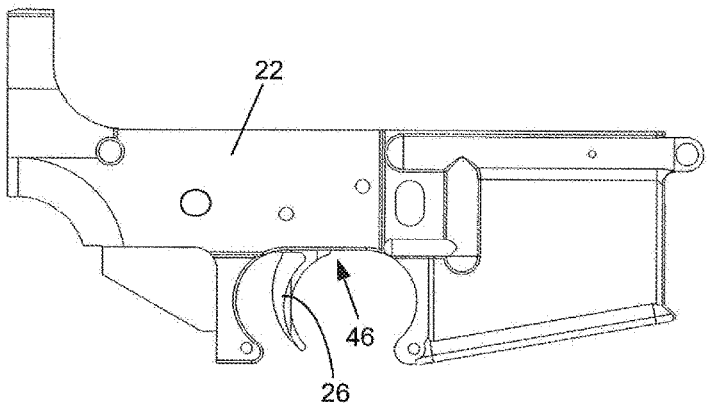
FIG. 2 (PRIOR ART)
FIG. 2 is a right side view of the prior art lower receiver of the firearm of FIG. 1.
Figure 3:
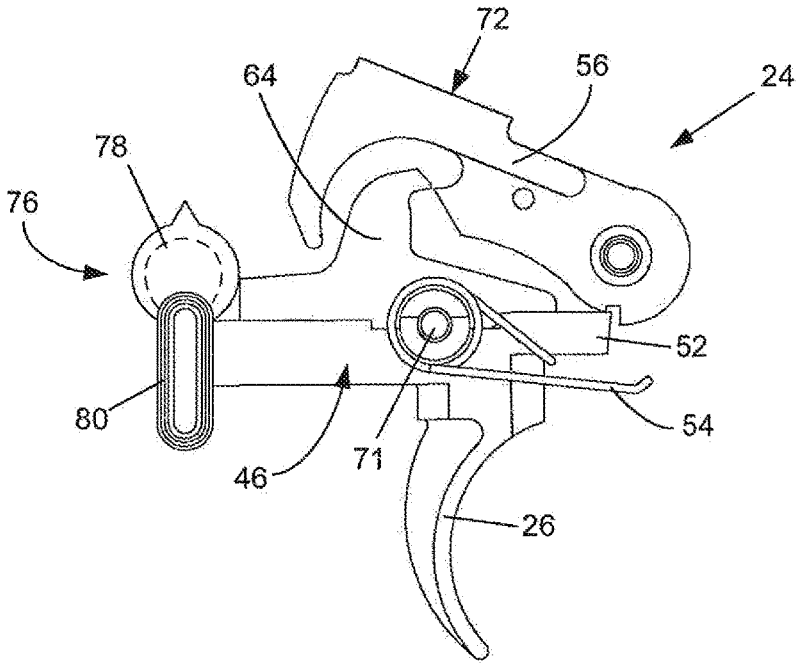
FIG. 3 (PRIOR ART)
FIG. 3 is a right side view of the prior art fire control group of the firearm of FIG. 1.
Figure 4:
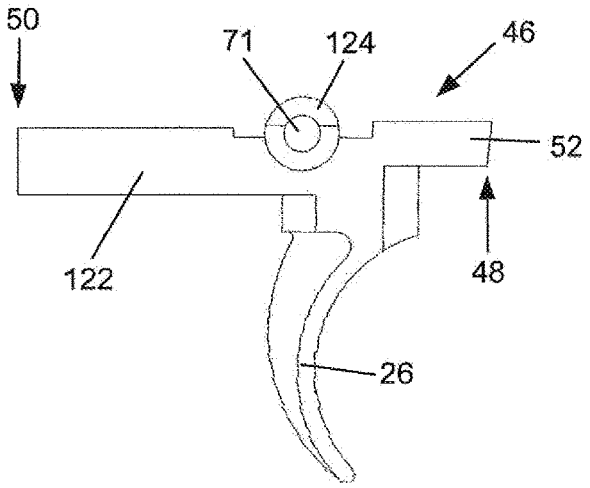
FIG. 4 (PRIOR ART)
FIG. 4 is a right side view of the prior art trigger assembly of the fire control group of FIG. 3.
Figure 5:
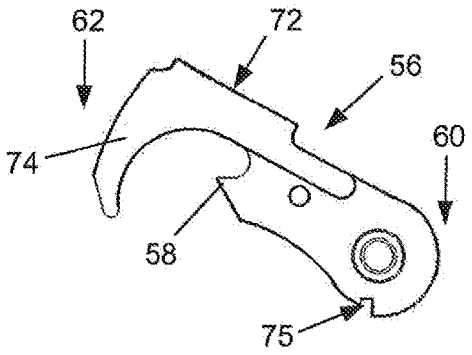
FIG. 5 (PRIOR ART)
FIG. 5 is a right side view of the prior art hammer of the fire control group of FIG. 3.

As set forth above and shown in FIGS. 1-2, the prior art firearm 14 has a lower receiver 22, positioned below the upper receiver 21, that supports the fire control group 24, shown in FIG. 3, that is operated by the operator of the firearm 14 to fire a projectile from the muzzle 34 at the end of the barrel 20 towards the first/forward end 16 of the firearm 14. The fire control group 24 of the firearm 14 has a trigger assembly 46 that supports the downwardly extending trigger 26 between a first/forward end 48 and a second/rearward end 50 of the trigger assembly 46, a sear 52 that is integral with or attached to the first/forward end 48 of the trigger assembly 46, a trigger spring 54 associated with the main body of the trigger assembly 46, a hammer 56 having a hook 58 associated therewith on its lower side approximately midway between the first/forward end 60 and the second/rearward end 62 of the hammer 56, and a disconnector 64 that has an upwardly extending, forwardly disposed hook 66 that is located approximately midway between the first/forward end 68 and second/rearward 70 of the disconnector 64, as shown in FIGS. 3-6. The disconnector rotates about a trigger pin 71 located at the top side of the trigger assembly 46, as shown in FIGS. 3-4. The hammer 56 has a hammer face 72, a downwardly disposed rearward hook 74 and lower, forwardly disposed notch 75, as best shown in FIG. 5, with the hammer face 72 being configured to strike against the firing pin of a round that is fed into the lower receiver 22 from the magazine 28 when the hammer 56 is pivoted forward upon the operator squeezing the trigger 24. The configuration and use of the various components of the fire control group 24 of a prior art firearm 14 are generally well known to persons who are skilled in the relevant art.

As with most firearms, the prior art AR-15 style firearm 14 shown in FIG. 1 has a safety selector 76, shown in FIG. 3, that allows the operator to manually select between the safety selector 76 being in a safe position that prevents the firearm 14 from being fired and a fire position that allows the firearm 14 to be fired. The sequence for firing a standard prior art AR-15 style firearm, such as the prior art firearm 14 shown in FIG. 1, initially starts with the safety selector in the safe position with the barrel 78 of the safety selector positioned over a rearward portion of the trigger assembly 46, which prevents sufficient movement of the trigger 26 and, therefore, the fire control group 24 that would otherwise allow the firearm 14 to fire a projectile from the firearm 14. When the operator is ready to fire the firearm 14, he or she moves the switch lever 80 of the safety selector 76 from the safe position to the fire position. Movement of the switch lever 80 to the fire position rotates the barrel 78 of the safety selector 76 to a position such that it no longer obstructs the trigger assembly 46 and, as a result, no longer prevents the trigger 26 from moving. When the operator pulls the trigger 26 rearward to fire the firearm 14, the trigger assembly 46 releases the notch 75 of the hammer 56 from the sear 52 of the trigger assembly 46, causing the hammer 56 to rotate forward and strike the firing pin of the round with the hammer face 72. The projectile of the round is discharged from the first/forward end 16 of the firearm 14 and the gas that is diverted to a gas tube from the discharged round forces the bolt carrier group of the firearm 14 rearward. The rearward movement of the bolt carrier group pushes the hammer 56 back into the disconnector 64 where the hook 58 of the hammer 56 is captured by the hook 66 of the disconnector 64. This process happens so fast that the operator of the firearm 14 will still have the trigger 26 pulled rearward. The operator then releases the trigger 26 so the trigger spring 54 can return the trigger 26 and the trigger assembly 46 to their firing positions. As the trigger assembly 46 rotates back to its firing position, the sear 52 of the trigger assembly 46 pushes the first/forward end 68 of the disconnector 64 up, which makes the disconnector 64 rotate about the trigger pin 71 resulting in the disconnector 64 releasing the hook 58 of the hammer 56 from the hook 66 of the disconnector 64. This allows the hammer 56 to rotate back in the direction toward the firing pin of the round until the notch 75 of the hammer 56 is captured by the sear 52 of the trigger assembly 46, as shown in FIG. 3. Because the switch lever 80 of the safety selector 76 is still in its fire position, the firearm 14 is ready to be fired again upon pulling of the trigger 26 by the operator, without additional action by the operator with regard to any manual manipulation of the safety selector 76.

The new fire control lockout assembly 10 of the present invention generally comprises the same components set forth above for the fire control group 24 and safety selector 76 of the prior art firearm 14 described above. As set forth in more detail below, in a first embodiment of the new fire control lockout assembly 10 utilizes a modified disconnector, shown as 82 in FIGS. 9-16, and a protrusion 84 associated with safety selector 76 extending generally forward toward the new disconnector 82, as shown in FIGS. 14-16 and 19-26, with all other components of the fire control group 24 being configured and operating in the same manner as used in the prior art firearm 14. In a second embodiment of the present invention, the lockout assembly 10 utilizes a modified trigger assembly 46 and the protrusion 84 associated with the safety selector 76, with all other components of the fire control group 24 being configured and operating in the same manner as used in the prior art firearm 14. When utilized in place of the prior art fire control group 24 and the prior art safety selector 76, the firearm 12 having the lockout assembly 10 will be limited to single shot operation and, therefore, no longer be able to operate in semiautomatic firing mode, as is the standard operation for the prior art firearm 14 not having the new lockout assembly 10. More specifically, as described in more detail below, the use of the protrusion 84 on the safety selector 76 with either the modified disconnector 82 or modified trigger assembly 86 prevents the hammer 56 from automatically disconnecting from the disconnector 64 after firing a round, which prevents the firearm 12 from being able to fire a subsequent round from the firearm 12 without manual intervention by the operator of the firearm 12 to move the safety selector 76 from its safe (i.e., non-firing) position 88, shown in FIGS. 14-17 and 20, to its fire position 90, shown in FIGS. 18-19 and 21-26.

Figure 6:
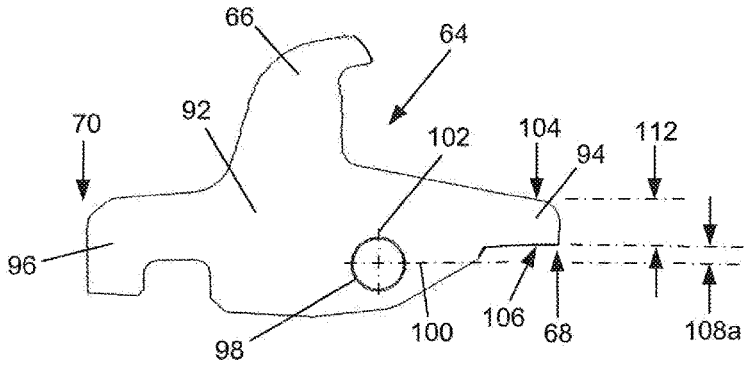
FIG. 6 (PRIOR ART)
FIG. 6 is a right side view of the prior art disconnector of the fire control group of FIG. 3.
Figure 13:
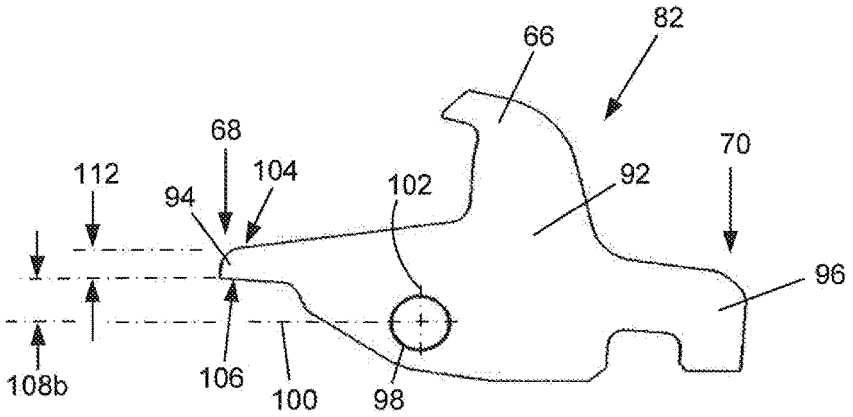
FIG. 13 is a right side view of the modified disconnector of the fire control group of FIG. 12.

As best shown in FIGS. 10-13, the modified disconnector 82 of the fire control lockout assembly 10 that is utilized with the new firearm 12 is, at least generally, configured substantially the same as the disconnector 64 that is utilized with the prior art fire control group 24 of the prior art firearm 14. More specifically, the modified disconnector 82 has an upwardly disposed, forward leaning hook 66 that is positioned approximately midway between the first/forward end 68 and the second/rearward end 70 of the disconnector 82. As shown with regard to FIG. 6 for the prior art disconnector 64 and with regard to FIGS. 12-13 for the modified disconnector 82, both the prior art disconnector 64 and the modified disconnector 82 have a disconnector body 92 that extends between the first/forward end 68 and the second/rearward end 70 and to which the hook 66 is either integrally formed (as is typical) or attached so as to extend above the disconnector body 92. The body 92 of both the prior art disconnector 64 and the new disconnector 82 defines a forward extending segment 94 at the first/forward ends 68 of the disconnectors 64/82 and a rearward extending segment 96 at the second/rearward ends 70 thereof that extend outward in opposite directions from the hook 66, as best shown in FIGS. 6 and 13. The body 92 of both the prior art disconnector 64 and the new disconnector 82 has a pivot aperture 98 which receives the trigger pin 72 so as to allow either disconnector 64/82 to pivot in response to the sear 52 of the trigger assembly 46 pushing the forward segment 94 of the disconnector 64/82 up, which causes the disconnector 64/82 to release the hook 58 of the hammer 56 from the hook 66 of the disconnector 64.

For purposes of describing the configuration and operation of the new lockout assembly 10 of the present invention, the pivot aperture 98 has a centrally disposed horizontal axis 100 and vertical axis 102 and the forward segment 94 has an upper surface 104 and a lower surface 106, as best shown in FIGS. 6, 12, 13 and 26. During the firing cycle of the prior art firearm 14, the trigger sear 52 at the first/forward end 48 of the trigger assembly 46 contacts the lower surface 106 of the forward extending segment 94 of the disconnector 64 to push the first/forward end 68 of the disconnector 64 upward to release the hook 58 of the hammer 56 from the hook 66 of the disconnector 64. The amount of movement of the trigger sear 52 that is required to contact the lower surface 106 of the forward extending segment 94 of the modified disconnector 82 (first embodiment) or the prior art disconnector 64 (second embodiment) is determined by the contact spacing 108, which is defined for purposes of the present invention as being the distance between the horizontal axis 100 through the center of the pivot aperture 98 and the lower surface 106 of the forward extending segment 94 of the disconnector 64/82, as best shown in FIGS. 6 and 13. As set forth in more detail below, the prior art firearm 14 has a fire control group 24 with a contact spacing 108 (shown as prior art contact spacing **108*a* in FIG. 6) that allows sufficient upward contact by the sear 52 to pivot the disconnector 64 far enough for the disconnector 64 to release the hammer 56. In contrast, the new lockout assembly 10 is configured such that the contact spacing 108 (shown as new contact spacing 108*b* in FIG. 13) is greater than the prior art contact spacing 108*a*, which prevents sufficient upward contact by the trigger sear 52 to pivot either the modified disconnector 82 (for the first embodiment) or the prior art disconnector 64 (for the second embodiment) far enough to allow the disconnector 82/64 to automatically release the hammer 56, thereby requiring manual intervention by the operator of the firearm 12**.

In the first embodiment of the lockout assembly 10, the disconnector 82 is modified, relative to the prior art disconnector 64 (as set forth below), to have the increased new contact spacing **108*b* such that when the trigger assembly 46 pivots, the trigger sear 52 is unable to sufficiently contact the first/forward end 68 of the disconnector 82 to release the hammer hook 58 of the hammer 56 from the hook 66 of the disconnector 82. Likewise, in the second embodiment, the trigger assembly 86 is modified, relative to the prior art trigger assembly 46 (as set forth below), to have the increased new contact spacing 108*b* such that when the trigger assembly 86 pivots, the trigger sear 52 is unable to sufficiently contact, if at all, the first/forward end 68 of the disconnector 64 to release the hammer hook 58 of the hammer 56 from the hook 66 of the disconnector 82. If desired, the new firearm 12 can have a lockout assembly 10 having both a modified disconnector 82 and a modified trigger assembly 86. In any embodiment, as a result of the modified disconnector 82 and/or modified trigger assembly 86 providing an increased new contact spacing 108*b*, the trigger sear 52 is not able to move the disconnector 64/82 of the lockout assembly 10 far enough to release the hammer 56, thereby preventing the firearm 12 having the fire control lockout assembly 10 from being able to fire a subsequent round until manual intervention by the operator of the firearm 12. As explained below, the manual intervention required by use of the new lockout assembly 10 is the manual operation of the safety selector 76 between its safe position 88 and its fire position 90 by the operator of the firearm 12. In effect, the previous quick capture and release of the hammer 56 by the prior art disconnector 64, which is done to delay repositioning the hammer 56 back into place to be directed at the firing pin while the BCG moves forward past the fire control group 24, is interrupted by the modified fire control group 24 (having either the modified disconnector 82 or the modified trigger assembly 86) so as to not release the hammer 56** until the manual action by the operator.

As set forth above, during the firing sequence of the prior art firearm 14, the rearward movement of the BCG resulting from the diversion of gasses from a fired round pivots the hammer 56 backward and downward to cause the hook 66 of the disconnector 64 to engage the hook 58 of the hammer 56 to briefly capture the hammer 56 below the movement area of the BCG in order to allow the BCG to move forward again, by action of the recoil spring, past the fire control group 24. Though very brief, the capture of the hammer 56 by the disconnector 64 is enough to allow the BCG to move forward past the hammer 56 of the fire control group 24. As also set forth above, the forward movement of the BCG pulls a fresh round from the magazine 28 and chambers it in the upper receiver 21 so the round will be in position to be fired. The movement of the BCG is so fast that the rearward and subsequent forward movement of the BCG happens before the operator can even release the trigger 26. When the operator does release the trigger 24, the trigger spring 54 rotates the trigger assembly 46 to its firing position to place the hammer 56 in position to once again strike the firing pin. More specifically, as the trigger assembly 46 is rotating back to its firing position, the sear 52 of trigger assembly 46 pushes the first/forward end 68 of the disconnector 64 upward to cause the disconnector 64 to rotate about the trigger pin 71 and cause the disconnector 64 to release the hook 58 of the hammer 56 from the hook 66 of the disconnector 64. The hammer 56 rotates back toward the firing pin where the notch 75 (i.e., lower sear) of the hammer 56 is captured by the trigger sear 52, placing the firearm 14 back in its ready-to-fire position.

The modification of disconnector 82 that distinguishes it from the prior art disconnector 64 pertains to the relationship and interaction between the trigger sear 52 and the forward segment 94 of the disconnector body 92. Specifically, the contact spacing 108 resulting from the distance between the trigger sear 52 of the trigger assembly 46 and the forward segment 94 of the disconnector 64 is modified to provide the increased distance of the new contact spacing 108*b* so the trigger sear 52 is not able to push the first/forward end 68 of disconnector 64 far enough upward to release the hook 58 of the hammer 56 from the hook 66 of disconnector 64 when the operator releases the trigger 26. Instead, as set forth in detail below, the present invention requires the operator to manually operate the safety selector 76 having protrusion 84 to cause the modified disconnector 92 (first embodiment) or the prior art disconnector 64 (second embodiment) to release the hammer 56 to place the fire control group 24 back into its firing position ready to fire a subsequent round from the firearm 12 having the new lockout assembly 10. In either of these embodiments, the contact spacing 108 of the fire control group 24 of the firearm 12 having the lockout assembly 10 (i.e., the new contact spacing 108*b*) is greater than the contact spacing 108 of the fire control group 24 of the prior art firearm 14 not having the lockout assembly 10.

Figure 26:
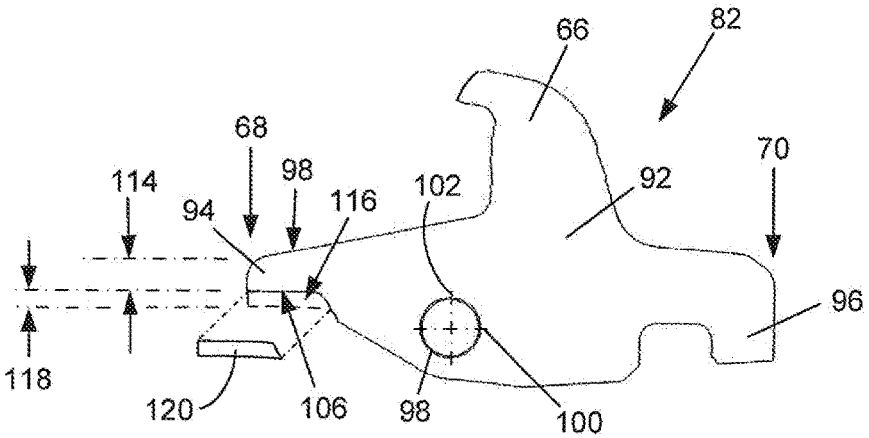
FIG. 26 is a right side view of an alternative configuration for the disconnector of the fire control group of FIG. 12 showing a removed section taken from the forward segment at the first end of the disconnector.

The increased distance provided by the new contact spacing 108*b* results in more space, referred to as lockout gap 110 (shown in FIGS. 14, 16, 19, 20 and 24), between the trigger sear 52 of the trigger assembly 46 and the forward segment 94 of the disconnector 82 that provides the desired inability of the sear 52 to automatically (i.e., without manual manipulation by the firearm operator) move the disconnector 82 far enough for the disconnector 82 to release the hammer 56, which inability to automatically release the disconnector 82 is necessary for the operation of the present invention. For purposes of describing the features of the present invention, the forward segment 94 of the prior art disconnector 64 has segment dept 112 that is measured between the upper surface 104 and the lower surface 106 thereof, as shown in FIG. 6, and the forward segment 94 has a segment depth 114 that is measured between the upper surface 104 and the lower surface 106 thereof, as shown in FIGS. 13 and 26. In one configuration of the first embodiment of the present invention, segment depth 114 of the forward segment 94 of the modified disconnector 82 is the same or substantially the same as the segment depth 112 of the forward segment 94 of the prior art disconnector 64. In this configuration, the increased contact spacing 108 is achieved by, in effect, shifting or pivoting the forward segment 94 slightly upward to increase the contact spacing 108 and, therefore, the lockout gap 110 that prevents the upwardly pivot movement of the trigger sear 52 from being able to sufficiently contact the forward segment 94 of the disconnector 64 to cause the hook 66 of the disconnector 64 to disengage from and, therefore, release the hook 58 of the hammer 56 to prevent the firearm 12 from being able to be fired until, as described in more detail below, the operator releases the hammer 56 by manually manipulating the safety selector 76 having the protrusion 84. The benefit of this configuration of the disconnector 82, relative to the alternative configuration of the disconnector 82 described below, is that the structural integrity of the forward segment 94 will generally remain the same by not decreasing, or at least not substantially decreasing, the segment depth 114 of the modified disconnector 82 relative to the segment depth 112 of the prior art disconnector 64.

In the alternative configuration of the modified disconnector 82, the increased contact spacing 108 for the lockout gap 110 is achieved by providing a segment depth 114 that is sufficiently less than the segment depth 112 of the prior art disconnector 64. This configuration can be accomplished by, as shown in FIG. 26, by having a removed area 116 that, when compared to a similarly sized prior art disconnector 64, is formed when a portion of the forward segment 94 is missing or removed from the forward segment 94. As shown in FIG. 26, the removed area 116 has a depth 118, with the removed portion of the forward segment 94 that forms the removed area 116 being represented by the removed segment 120 shown in spaced apart relation to the forward segment 94 of the new disconnector 82. The removed area 116 of the disconnector 82 results in an increased contact spacing 108 that provides the lockout gap 110 between the lower surface 106 of the forward segment 94 of the disconnector 82 and the trigger sear 52 during the firing cycle of the firearm 12 when the trigger sear 52 would otherwise push against the lower surface 106 of the forward segment 94 to move the disconnector 82 and release the hook 58 of the hammer 56 from the hook 66 of the disconnector 64. Because the removed area 116 increases the contact spacing 108 and provides the lockout gap 110, the trigger sear 52 is not able to sufficiently move the forward segment 94 at the first/forward end 68 of the disconnector 82 far enough to release the hammer 56 from the disconnector hook 66. This leaves the disconnector 82 holding the hammer 56 and prevents the firearm 12 from firing a subsequent round without the operator of the firearm 12 manually manipulating the safety selector 76 by moving the switch lever 80 to place the safety selector 76 in its safe position 86 and then back to its fire position 88. This two step manual manipulation of the safety selector 76 prevents the firearm 12 from being a semiautomatic weapon and results in single shot operation of the firearm 12. As will be readily appreciated by persons who are skilled in the art, the forward segment 94 of the new or modified disconnector 82 having the segment dept 114 for the fire control lockout assembly 10 of the present invention can be achieved by modifying a prior art disconnector 64 by to actually remove the removed segment 120 therefrom or by providing a new disconnector 82 that has the forward segment 94 with the desired segment depth 114 (i.e., manufactured with the removed area 116 already removed from the forward segment 94 of the disconnector 82).

Whether the increased contact spacing 108 is achieved by changing the configuration of the forward segment 94 of the disconnector 82 while keeping the segment depth 114 the same or substantially the same as the segment depth 112 of the prior art disconnector 64 or by reducing the segment depth 114 by, in effect, having a removed area 116 absent from the disconnector 64. In one embodiment, relative to a typical disconnector 64 that is utilized for prior art AR-15 style firearms 14, the increase in the distance of the contact spacing 108 that is needed to obtain the desired lockout gap 110 to obtain the single shot operation of the firearm 12 will typically be approximately 0.050 inches, though the increase in the contact spacing 108 (i.e., new contact spacing 108*b* relative to the prior art contact spacing 108*a*) may be about 0.040 to 0.070 inches. As set forth in more detail below, although the increase in the distance of the contact spacing 108 is relatively narrow, providing the increased contact spacing 108*b* and lockout gap 110 is critical to the operation of the new lockout assembly 10 to obtain the desired single shot operation of the firearm 12.

Figure 31:
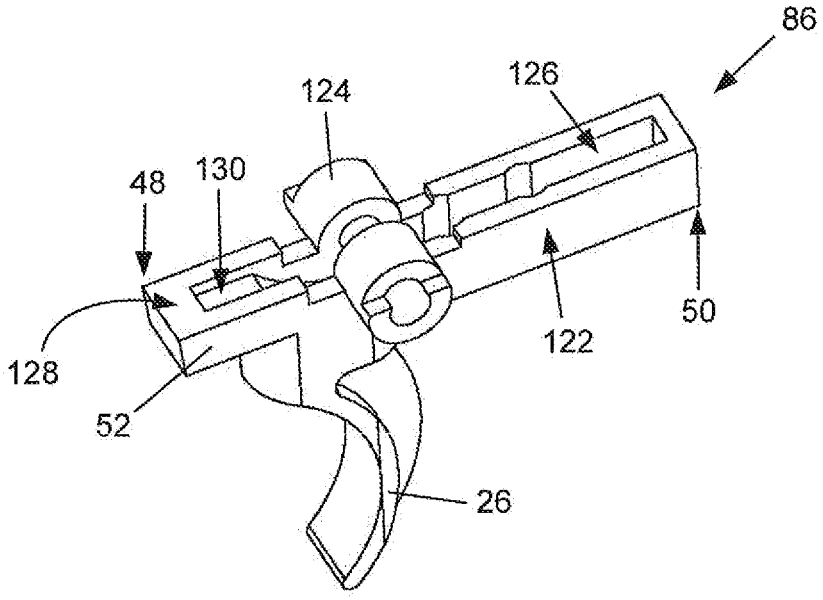
FIG. 31 is a left side perspective view of a modified trigger assembly that is utilized with a second embodiment of the fire control lockout assembly of the present invention particularly showing the lowered contact surface thereof.
Figure 32:
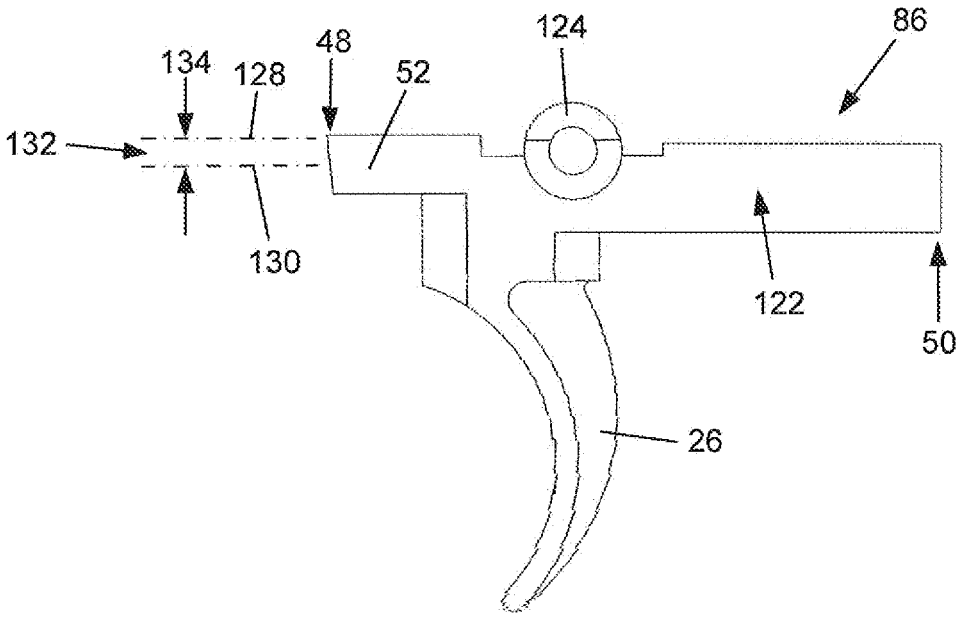
FIG. 32 is a left side view of the modified trigger assembly of FIG. 31.

A second embodiment of the fire control lockout assembly 10 of the present invention is shown in FIGS. 31-32. As set forth in more detail below, the second embodiment of the lockout assembly utilizes the modified trigger assembly 86, instead of or in addition to the modified disconnector 82 described above, to achieve the single shot operation benefits of the present invention for firearm 12. The second embodiment accomplishes the desired objectives by "removing" a portion of the prior art trigger assembly 46 (whether by actually removing the portion or manufacturing the trigger assembly 46 with the portion not there) to increase the contact spacing 108, as defined for the second embodiment below, between the trigger assembly 46 and the forward segment 94 of the disconnector 64. In this embodiment, the prior art disconnector 64, as well as the prior art hammer 56, is utilized with the new lockout assembly 10. Typically, instead of modifying a prior art trigger assembly 46 by removing a portion of the trigger assembly 46, the increased contact spacing 108 will be achieved by replacing the prior art trigger assembly 46 with the modified trigger assembly 84 or by replacing the entire fire control group 24 with a fire control group 24 with the modified trigger assembly 84.

Figure 29:
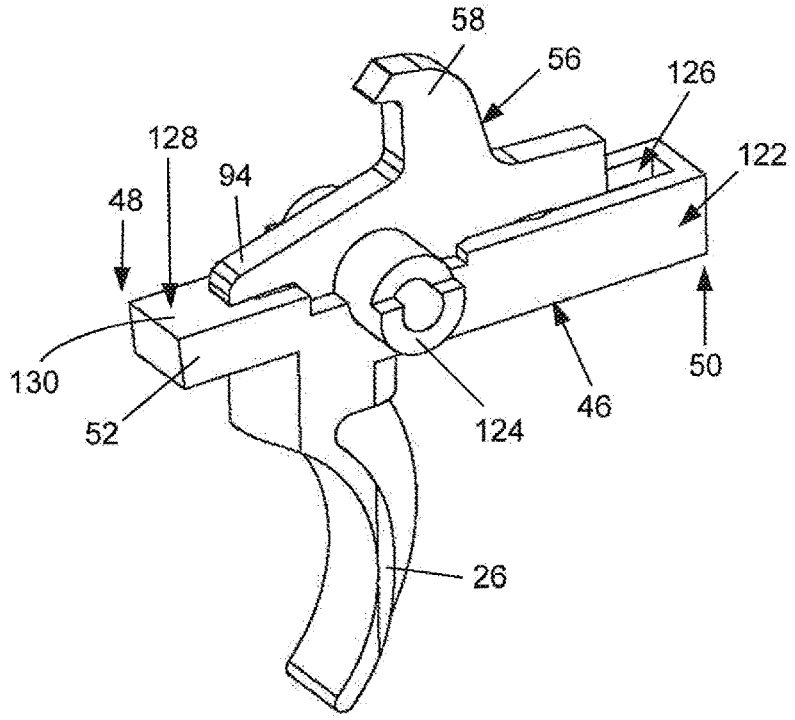
FIG. 29 (PRIOR ART)
FIG. 29 is a left side perspective view of the trigger assembly and disconnector of the prior art fire control group of FIG. 3.
Figure 30:
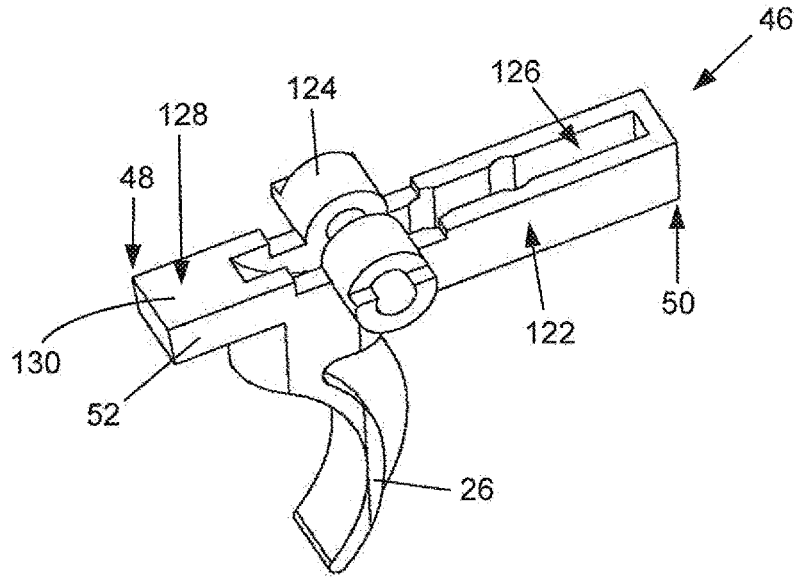
FIG. 30 (PRIOR ART)
FIG. 30 is a left side perspective view of the prior art trigger assembly of FIG. 29.

For purposes of describing the present invention, a prior art trigger assembly 46 is shown in FIGS. 29-30, with the disconnector 66 also shown in FIG. 29. The prior art trigger assembly 64 has a trigger body 122 that, typically, defines the trigger sear 52 at the first/forward end 48 and the trigger 26 between the first/forward end 48 and the second/rearward end 50 as a single integral unit. As best shown in FIG. 30, the trigger body 122 also defines a pivot housing 124 for the pivot pin 71 and a disconnector slot 126 that is sized and configured to receive the disconnector 64 so as to allow the disconnector to pivot relative to the trigger body 122 during operation of the prior art firearm 14 and the firearm 12 having the new lockout assembly 10. The trigger body 122 of the prior art trigger assembly 64 has a trigger sear 52 with an upper surface 128 that defines a co-planar sear contact surface 130. During the firing cycle of a prior art firearm 14, the upper surface 128 (which is also the sear contact surface 130) of trigger sear 52 at the first/forward end 48 of trigger assembly 46 contacts the lower surface 106 of the forward extending segment 94 of disconnector 64 to push the first/forward end 68 of the disconnector 64 upward to release the hook 58 of hammer 56 from the hook 66 of disconnector 64. As with the first embodiment, the amount of movement of the trigger sear 52 required to contact the lower surface 106 of the forward extending segment 94 of the prior art disconnector 64 is determined by a contact spacing 108, which for purposes of the second embodiment is defined as being the amount of distance between the sear contact surface 130 (which is also the upper surface 128 in the prior art) and the lower surface 106 of the forward extending segment 94 of the disconnector 64/82. The second embodiment increases the contact spacing 108 by lowering the sear contact surface 130 relative to the upper surface 128 of the trigger sear 52. As set forth in more detail below, by lowering the sear contact surface 130, the new contact spacing 108*b* resulting from lowering the sear contact surface 130 is greater than the prior art contact spacing 108*a*, resulting in a lockout gap 110 that prevents sufficient contact by the sear 52 to automatically pivot the prior art disconnector 64 far enough to release the hook 58 of the hammer 56 from the hook 66 of the disconnector 64.

Figure 33:
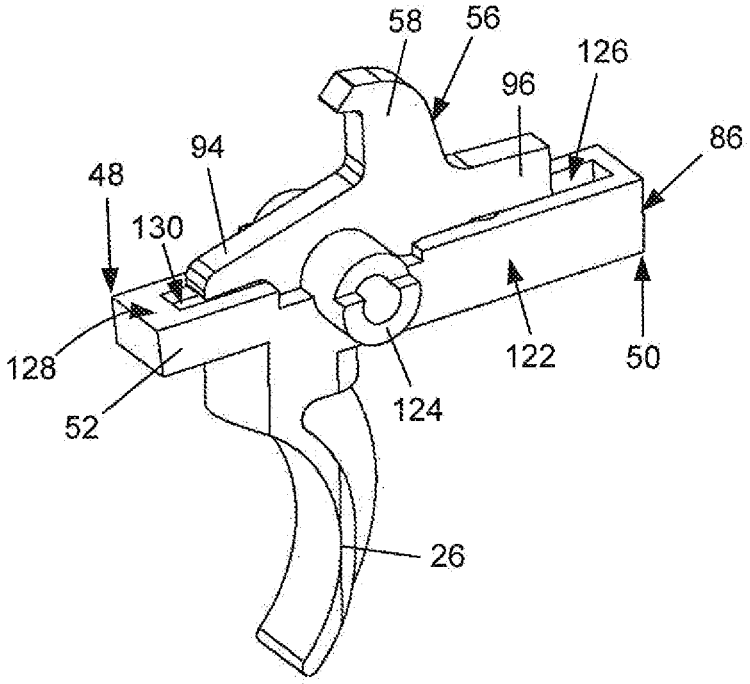
FIG. 33 is a left side perspective view of the trigger assembly and disconnector of the second embodiment of the fire control lockout assembly of the present invention using the modified trigger assembly of FIG. 31.

The increased contact spacing 108*b* for the lockout gap 110 of the second embodiment is achieved by providing a removed area 132 in the upper surface 128 of the trigger sear 52 that results in a contact surface 130 that is along a plane lower than the upper surface 128, such that the upper surface 128 and the contact surface 130 are no longer co-planar, as best shown in FIGS. 31-32. This configuration can be accomplished by, as shown in FIGS. 31-33, by having the removed area 132 of the modified trigger assembly 86 that, when compared to a prior art trigger assembly 64, is formed when a portion of the upper surface 128 of the trigger sear 52 is missing or removed from the trigger body 122. As shown in FIG. 32, the removed area 132 has a depth 134 that is selected to be sufficient to not allow the trigger sear 52 to be able to move the disconnector 64 far enough upward to release the hammer 56 from the disconnector. More specifically, as set forth above for both configurations of the first embodiment having the modified disconnector 82, the second embodiment provides a lower contact surface 130 that increases the contact spacing 108 to provide the lockout gap 110 which prevents the trigger body 122 being able to move far enough, compared to the prior art fire control group 24, to allow the hook 66 of the disconnector 64 to be able to release the hook 58 of the hammer 54 without manual intervention by the operator of the firearm 12 having the lockout assembly 10. As set forth above, in a typical use of the new lockout assembly 10, the owner or operator of a prior art firearm 14 will access the fire control group 24 and replace the prior art trigger assembly 46 with the modified trigger assembly 86, using the same hammer 56 and disconnector 64, to achieve the single shot objectives of the present invention. The depth 134 of the removed area 132 required to obtain the desired lockout gap 110 for single shot operation of the firearm 12 will typically be approximately 0.050 inches, though the increase in the contact spacing 108 (i.e., new contact spacing 108*b* relative to the prior art contact spacing 108*a*) may be about 0.040 to 0.070 inches.

As will be readily understood by persons skilled in the art, the contact spacing 108 is the distance the trigger sear 52 must pivot upward toward the forward segment 94 of the disconnector 64/82 before the sear contact surface 130 makes contact with the lower surface 106 of the forward segment 94. This contact causes the disconnector 64/82 to release the hook 58 of the hammer 56 from the hook 66 of the disconnector 64/82. For any embodiment, the contact spacing 108*b* provided by the new lockout assembly 10 has a greater distance than the contact spacing 108*a* that is provided by the use of the prior art trigger assembly 46 and prior art disconnector 64. This greater distance of the new contact spacing 108*b* prevents the trigger sear 52 from moving the disconnector 64/82 far enough for the disconnector 64/82 to release the hammer 56.

Figure 14:
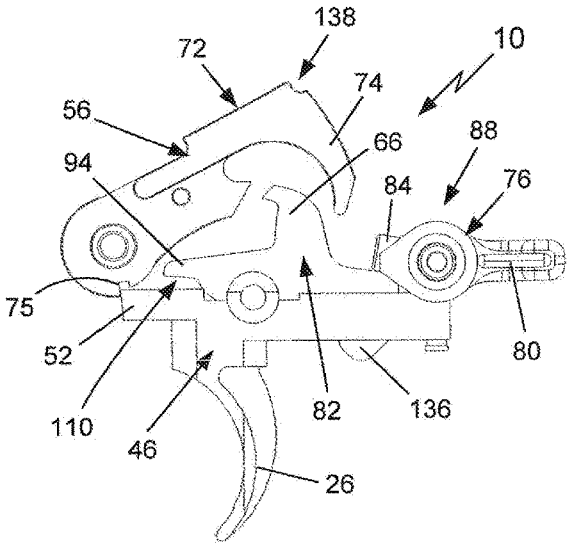
FIG. 14 is a left side view of the fire control group and fire selector of FIG. 9.
Figure 15:
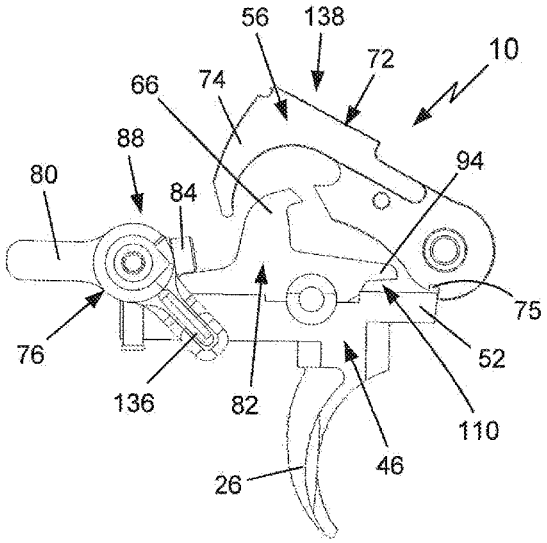
FIG. 15 is a right side view of the fire control group and fire selector of FIG. 14.
Figure 16:
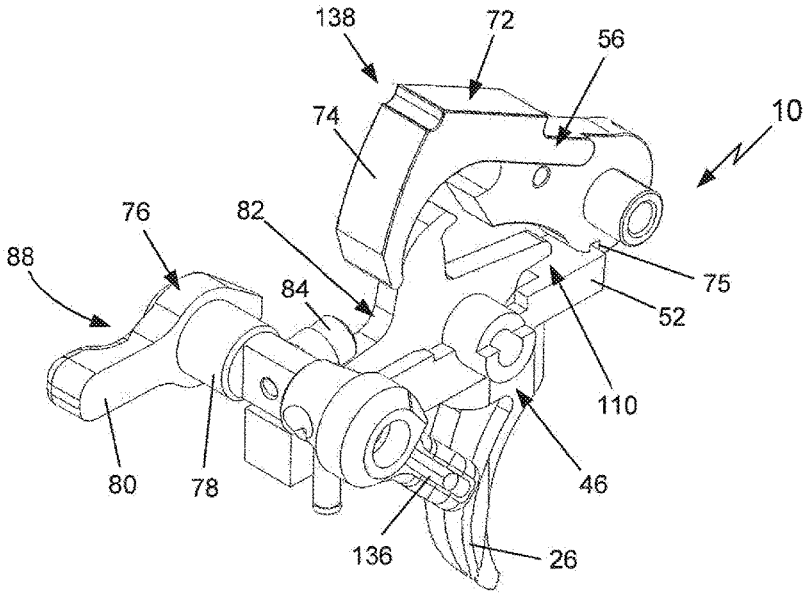
FIG. 16 is a rear perspective view of the fire control group and fire selector of FIG. 15.
Figure 17:
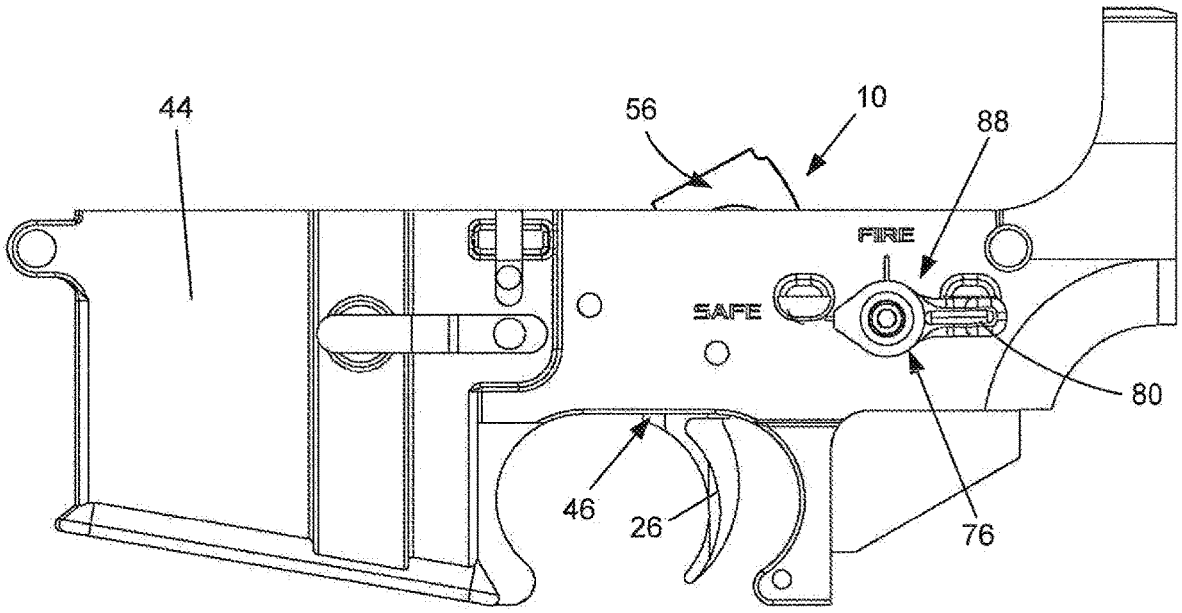
FIG. 17 is a left side view of the lower receiver of FIG. 7 showing the left sidewall of the lower receiver and the fire selector in its safe position.
Figure 18:
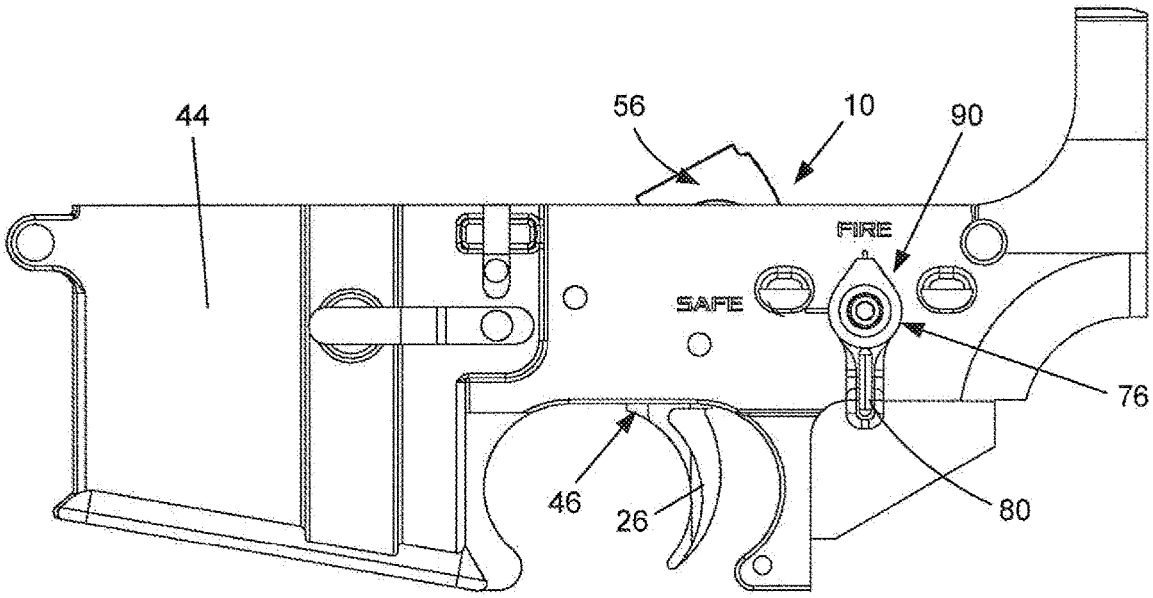
FIG. 18 is a left side view of the lower receiver of FIG. 17 showing the fire selector in its fire position.

As set forth above, in addition to having either a modified disconnector 82 or a modified trigger assembly 86, the fire control lockout assembly 10 of the present invention utilizes a safety selector 76 that comprises a barrel 78 that is structured and arranged to engage the rearward segment 96 of either the prior art disconnector 64 or the modified disconnector 82 so as to push downward on the rearward segment 96 and release the hammer 56 from the disconnector 64/82. In the embodiment shown in the figures, the safety selector 76 has a protrusion 84 that is integral with or attached to barrel 78, as best shown in FIGS. 14-16. The protrusion is sized and configured to extend outward from the barrel 78 of the safety selector 76. More specifically, the protrusion 84 extends generally forward from the barrel 78 of the safety selector 76 when the safety selector 76 is in its safe position 88, as shown in FIGS. 14-16, and generally upward from the barrel 78 when the safety selector 76 is in its fire position 90, FIGS. 19 and 21-26. The barrel 78 of the standard prior art safety selector 76 has a hemicylindrical block that is positioned so an edge of the cylinder contacts the second/rearward end 50 of the trigger assembly 46 when the safety selector 76 is in its safe position 88 to prevent the trigger assembly 46 being able to rotate and thus keeping the hammer 56 and sear 52 engaged. In the fire position 90, the block rotates so that the flat surface of the hemicylinder block faces the trigger body 122 of the trigger assembly 46, clearing the obstruction that was preventing pulling the trigger 26.

Figure 8:
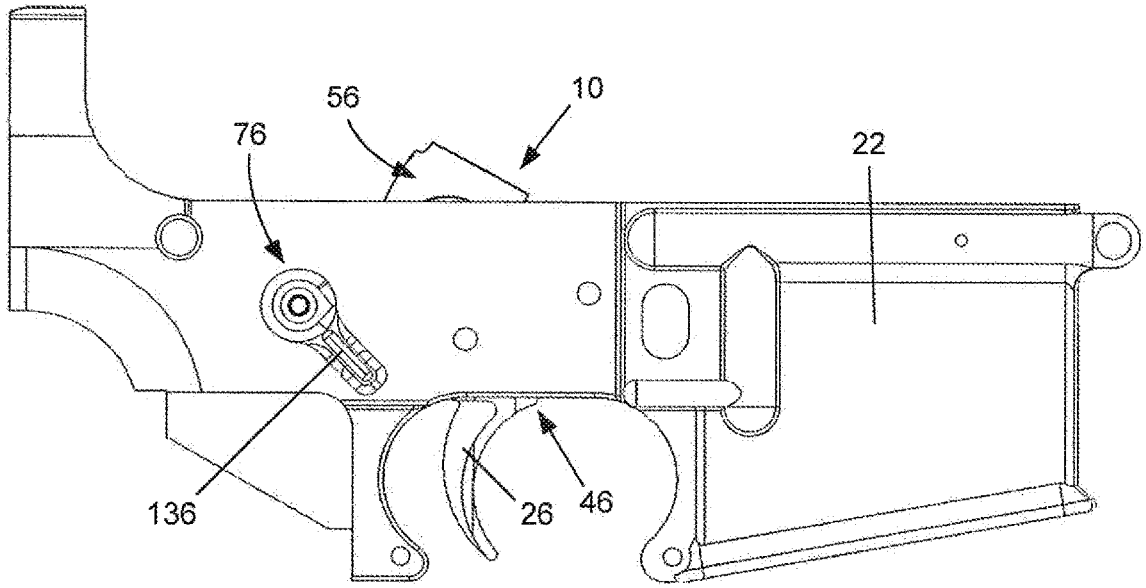
FIG. 8 is a right side view of the one-half of the lower receiver of the firearm of FIG. 7.
Figure 9:
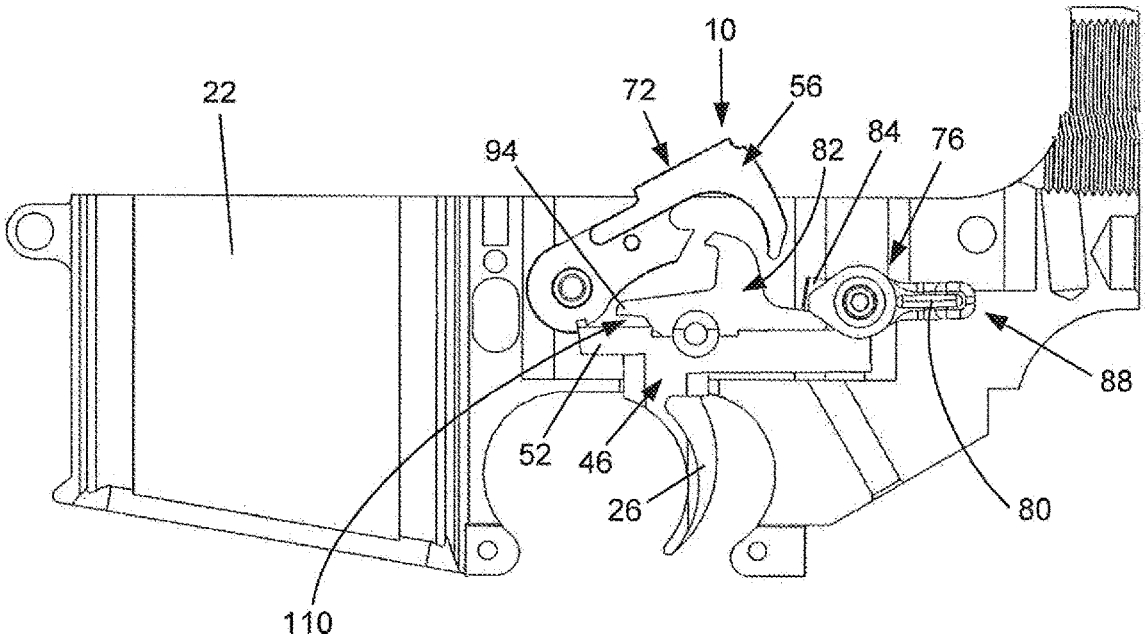
FIG. 9 is left side view of the lower receiver of FIG. 8 particularly showing the fire control group and fire selector thereof, with the fire selector shown in its safe position.
Figure 10:
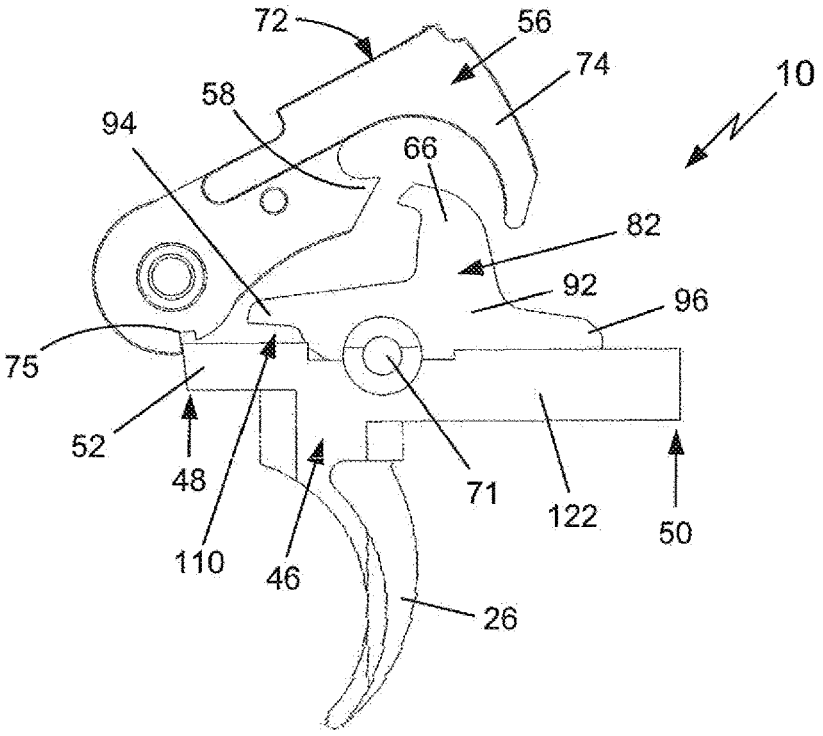
FIG. 10 is a left side view of the fire control group of FIG. 9.
Figure 11:
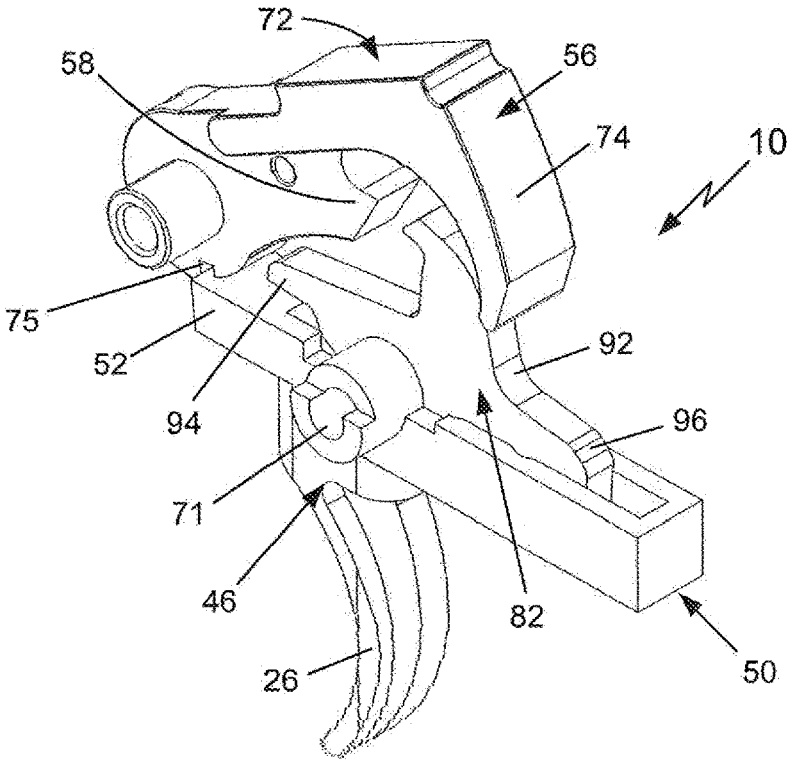
FIG. 11 is a left side perspective view of the fire control group of FIG. 10.
Figure 12:
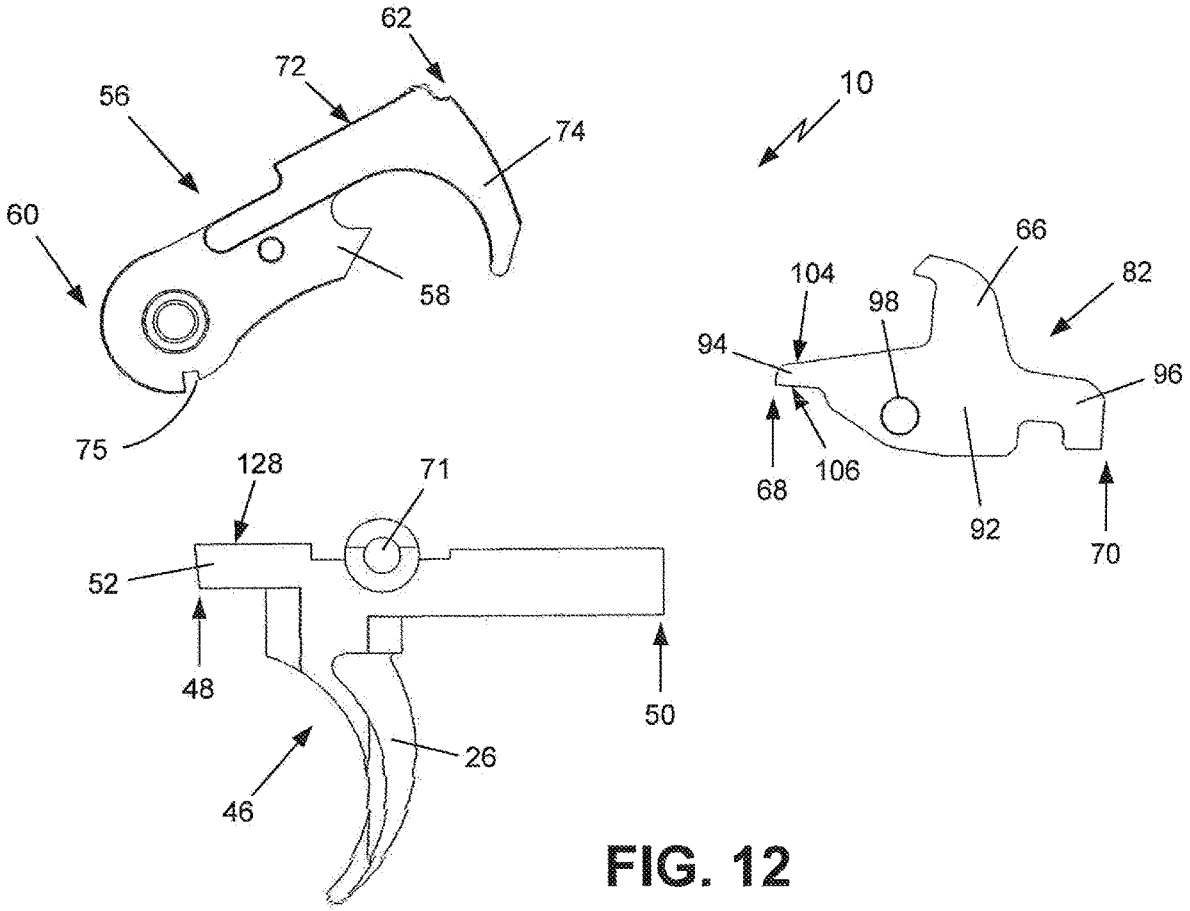
FIG. 12 is an exploded left side view of the fire control group of FIG. 10.

As shown in the relevant figures, the protrusion 84 of the new lockout assembly 10 is sized and configured to extend sufficiently forward from the barrel 78 of the safety selector 76 (i.e., relative to the elongated axis through the barrel 78) so as to be positioned in abutting relation above the second/rearward end 70 of the modified disconnector 82 (first embodiment) or the prior art disconnector 64 (second embodiment) when the safety selector 76 is in its safe position 88 so as to prevent the disconnector 82/64 from pivoting forward while the safety selector 76 is in its safe position 88, as will be readily appreciated by review of FIGS. 14-16 and 20. The length of the protrusion 84, however, should not be so long as to interfere with the operation of the firearm 12 during the remaining firing sequence thereof. In the embodiment where the fire control lockout assembly 10 is being utilized with the typically sized components of a standard or typical AR-15 style firearm 14, the protrusion 84 will have a length of approximately 0.20 inches from the surface of the selector switch barrel 78, though it may range between 0.10 and 0.3 inches. In a preferred configuration of the lockout assembly 10 of the present invention, the safety selector 76 of the present invention also includes a second switch lever 136, best shown in FIGS. 8 and 15, on the opposite side of the lower receiver 22 than the first switch lever 80 to allow the user to be able to faster move the safety selector 76 between its safe position 88 and its fire position 90.

As will be readily appreciated by persons who are skilled in the relevant art, in other embodiments the barrel 78 of the safety selector 76 may be modified to engage the rearward segment 96 of the disconnector 64/82 without use of the protrusion 84. For instance, the barrel 78 may be provided with one or more cut-out areas that are sized and configured to engage or be engaged by the disconnector 64/82 at or near the second/rearward end 70 thereof so as to push or pull the rearward segment 96 sufficiently downward to release the hammer 56 from the disconnector 64/82 to place the hammer 56 in engagement with the sear 52, as described above, so the hammer 56 will be in position to be released when the operator of the firearm 12 pulls the trigger 26 to fire the firearm 12.

As set forth above, the new fire control lockout assembly 10 of the present invention for use with semiautomatic firearms 12/14, such as the AR-15 style rifles shown in FIGS. 1 and 7, results in single shot operation for firearm 12. In one use, the disconnector 64 of a prior art fire control group 24 and the safety selector 76 of an existing firearm 14 are modified as described above to add the protrusion 84 to the safety selector 76 and to either remove the removed segment 120 from the disconnector 64 or to remove the removed area 132 of the trigger assembly 46 to result in the firearm 12. In another use, the owner or operator of a prior art firearm 14 is provided with a safety selector 76 that has the protrusion 84 and either a modified disconnector 82 or modified trigger assembly 86 components so he or she can remove the fire control group 24 from the firearm 14 to replace the safety selector 76 with a safety selector 76 having the protrusion 84 and either replace the existing disconnector 64 with the modified disconnector 82 or replace the existing trigger assembly 46 with a modified trigger assembly 86. In yet another use, the operator uses a new firearm 12 that has the safety selector 76 with a protrusion 84 and either a modified disconnector 82 having the removed area 104 or a modified trigger assembly 86 with the removed area 132 at the trigger sear 52 (either of which will provide the necessary contact spacing 108*b*). Utilizing the above, the fire control lockout assembly 10 is structured and arranged such that when the trigger sear 52 moves back into position after a round has been fired from the firearm 14, the increased contact spacing 108*b* (relative to the prior art contact spacing 108*a*) will result in the trigger sear 52 being no longer able to move the forward segment 92 of the disconnector 64/82 far enough to push the first/forward end 68 thereof sufficiently upward to automatically (i.e., without any operator intervention) release the hammer 56 from the disconnector 64/82. For the prior art fire control group 24, pushing upward of the first/forward end 68 of the disconnector 64 causes the disconnector 64 to rotate about the trigger pin 71 and the disconnector 64 to release the hook 58 of the hammer 56 from the hook 66 of the disconnector 64. Because the first/forward end 68 of the modified disconnector 82 (for the first embodiment) or the disconnector 64 (for the second embodiment) is not able to be moved far enough by the trigger sear 52, the disconnector 82/64 is not able to sufficiently move the disconnector hook 66 so it can slide off of the hammer hook 58, the disconnector 64/82 remains in position holding the hammer 56. Remaining in position prevents the firearm 12 having the new fire control lockout assembly 10 from firing a subsequent round without intervention by the operator of the firearm 12, as described below and shown in the sequence of FIGS. 19-26. As also described below, the protrusion 84 comes into contact with the rearward segment 96 of the disconnector 64/82 when the safety selector 76 is rotated to its safe position 88, as shown in FIGS. 14-17 and 20. This results in the protrusion 84 pushing sufficiently downward against the rearward segment 96 of the disconnector 64/82 to cause the hook 66 of the disconnector 64/82 to slide off the hook 58 of the hammer 56, which is necessary to allow the hammer 56 to rotate to its ready position 138, as best shown in FIGS. 14-16 and 20, where the trigger sear 52 is engaging the notch 75 at or near the first/forward end 60 of the hammer 56 to hold the hammer 56 in its cocked, firing position. The switch lever 80 of the safety selector 76 can be moved to the fire position 90, shown in FIGS. 18-19 and 21-26, to allow the operator to fire another round from the firearm 12 by pulling the trigger 26, which angles the sear 52 downward and out of the hammer's cut-out notch 75 and releases the hammer 56 so the hammer face 72 will strike the firing pin of the round and discharge the projectile from the first/forward end 16 of the firearm 12 having the new lockout assembly 10.

Figure 19:
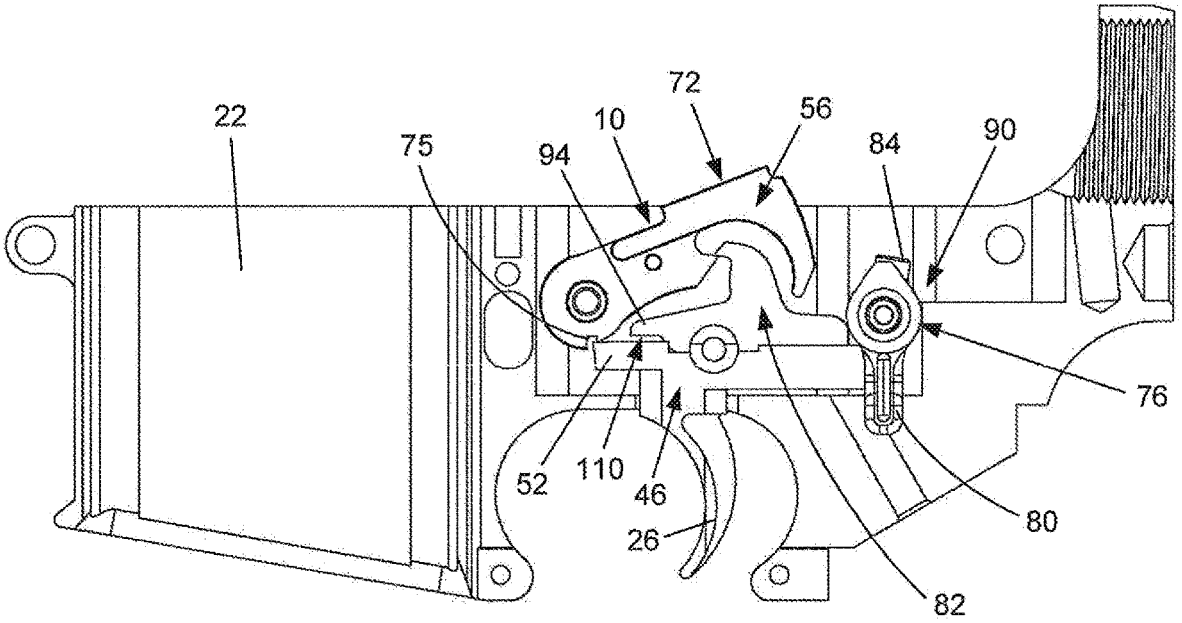
FIG. 19 is a left side view of the lower receiver of FIG. 18 showing the interior of the right sidewall of the lower receiver just after firing the firearm with the fire selector in its fire position.

The sequence of operation of firing a firearm 10 having the fire control lockout assembly 10 of the present invention is best shown with regard to FIGS. 19-25. FIG. 19 shows the new fire control lockout assembly 10 (first embodiment) and the modified safety selector 76 inside one-half of the lower receiver 22 just after firing a round from the firearm 12. In this figure, the bolt carrier group has moved the hammer 56 back to a position where the disconnector hook 66 has captured the hammer hook 58 to hold the hammer 56 in place. Although the trigger 26 has returned to its ready position, the increased contact spacing **108*b* prevents the trigger sear 52 from moving the disconnector 82 enough to release the disconnector hook 66 from the hammer hook 58. Despite the fact that the safety selector 76 is in its fire position 90, the new firearm 12 cannot be fired because the trigger sear 52 is not engaging the notch 75 at the first/forward end 60 of the hammer 56 to hold the hammer 56 in its ready position 138. The reason the trigger sear 52 is not engaging the notch 75 is due to the new disconnector 82 of the fire control lockout assembly 10 having the removed area 116, whether actually removed from the disconnector 82 (i.e., by modifying a prior art disconnector 64) or the firearm 12 has a disconnector 82 without the removed area 116 (whether the fire control group 24 of a prior art firearm 14 was modified to include the modified disconnector 82 or a firearm 12 was manufactured with the modified disconnector 82). As set forth above, the removed area 116 is sized and configured, including with depth 118, so as to provide a contact spacing 108 which prevents the trigger sear 52 from automatically separating the hammer hook 58 from the disconnector hook 66 and from engaging the notch 75 in the hammer 56, thereby removing the semiautomatic function of the firearm 12. As will be readily appreciated be persons who are skilled in the relevant art, absent specific manual action by the operator of the new firearm 12 to have the disconnector 82 re-engage the hammer 56, the firearm 12 will remain in its non-firing condition such that if the operator pulls on/squeezes the trigger 26 the hammer 56 will not move, which movement is necessary for the hammer face 72 to strike the firing pin of a subsequent round, which round has been chambered into its firing position. The specific action that is required is for the operator to manually engage one of the switch levers 80/136 to move the safety selector 76 to its safe position 88 and then back to its fire position 90 to separate the hammer 56 from the disconnector 82 and place the edge of the sear 52 in engagement with the notch 75 of the hammer 56**. This additional action results in the formerly semiautomatic firing operation being a single shot operation that, like bolt action rifles and the like, require the operator's manual intervention to fire the subsequent round.

Figure 20:
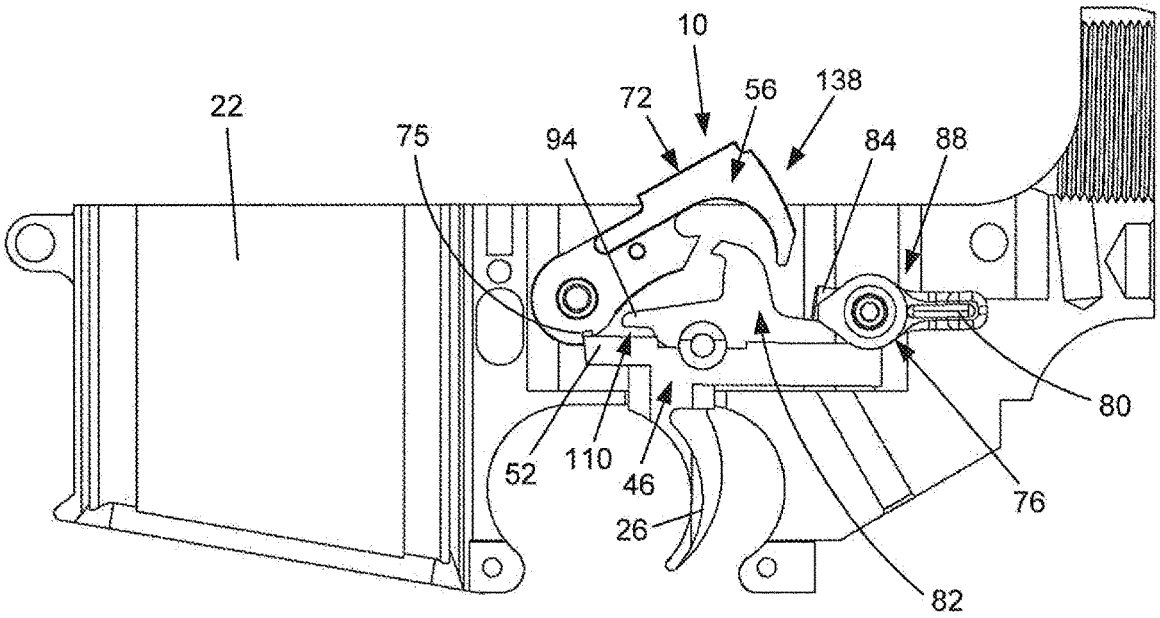
FIG. 20 is a left side view of the lower receiver of FIG. 19 with the fire selector rotated to its safe position.
Figure 21:
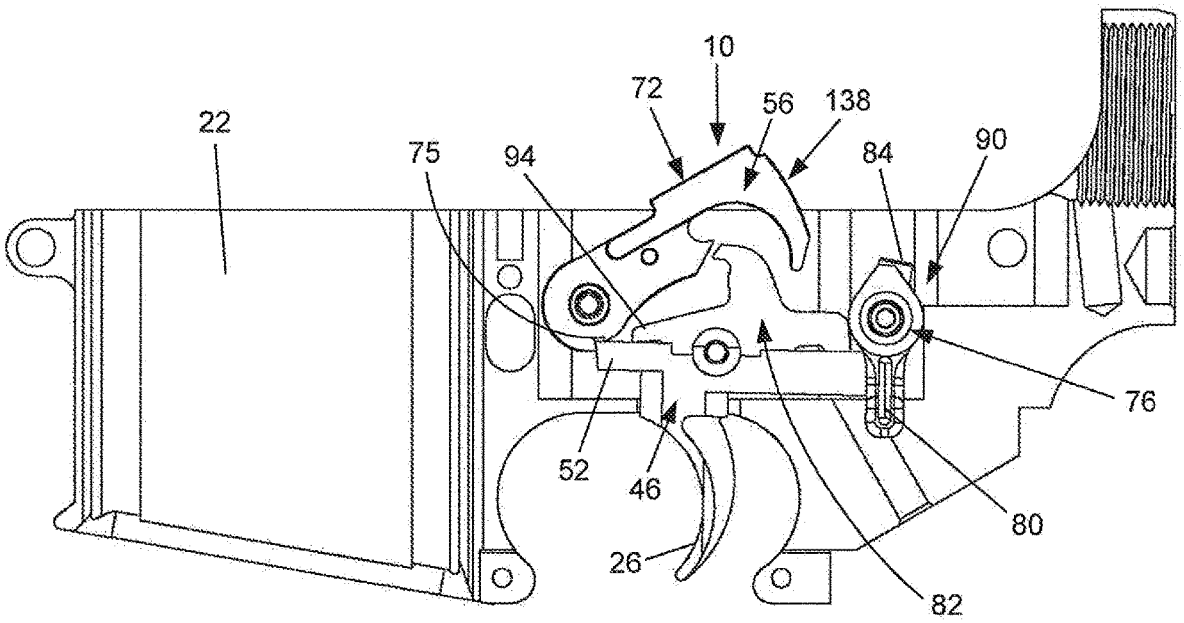
FIG. 21 is a left side view of the lower receiver of FIG. 20 with the fire selector rotated back to its fire position.
Figure 22:
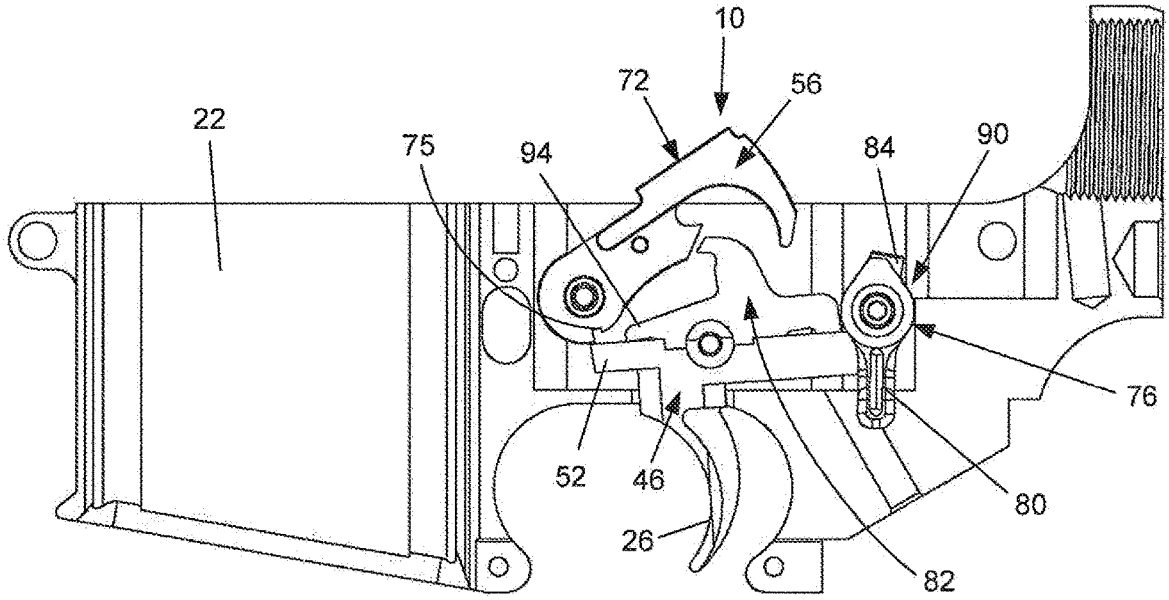
FIG. 22 is a left side view of the lower receiver of FIG. 21 showing the trigger pulled just before the hammer is released to strike the firing pin of a firearm.
Figure 23:
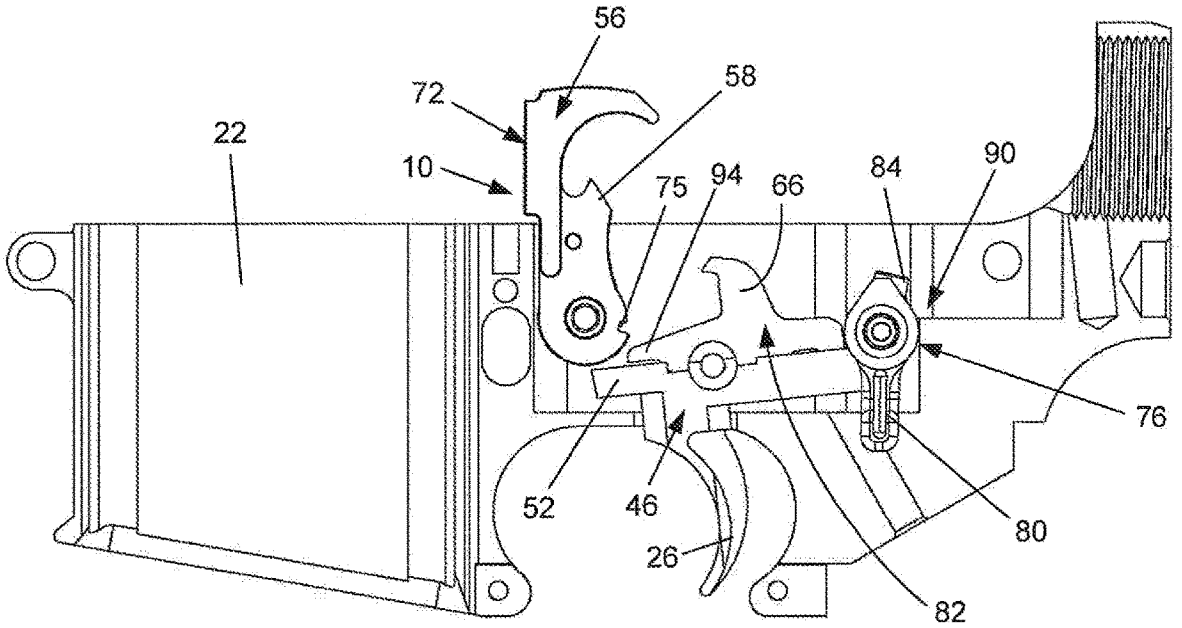
FIG. 23 is a left side view of the lower receiver of FIG. 22 showing the hammer having traveled to the position where it will strike the firing pin.
Figure 24:
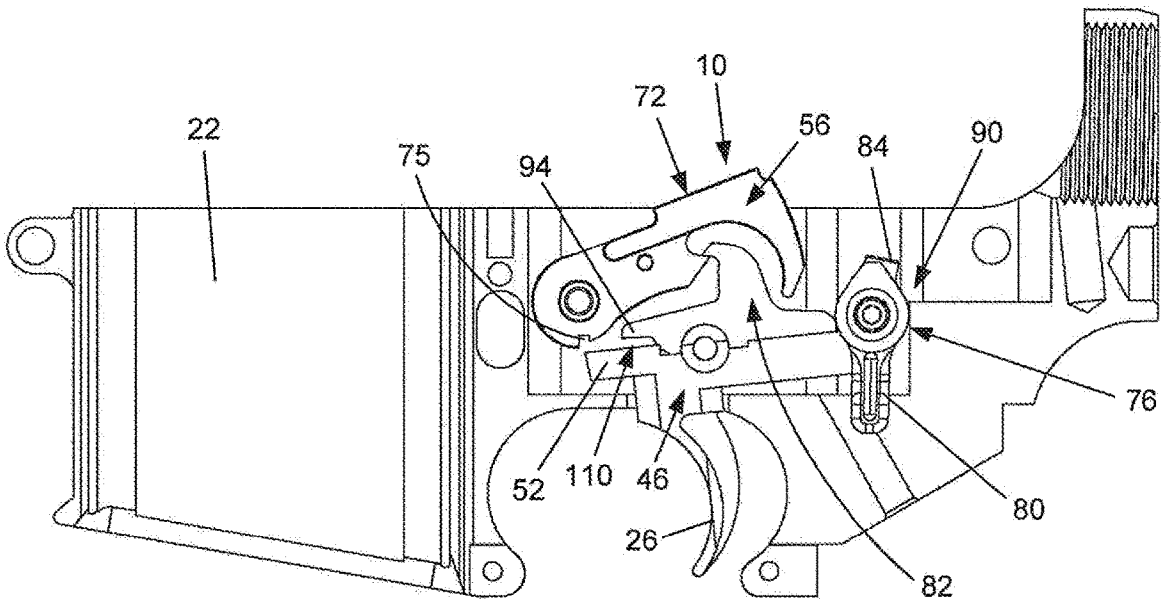
FIG. 24 is a left side view of the lower receiver of FIG. 23 showing the hammer pivoted rearward after being engaged by the firearm's bolt carrier group after the firing of a round from the firearm.
Figure 25:
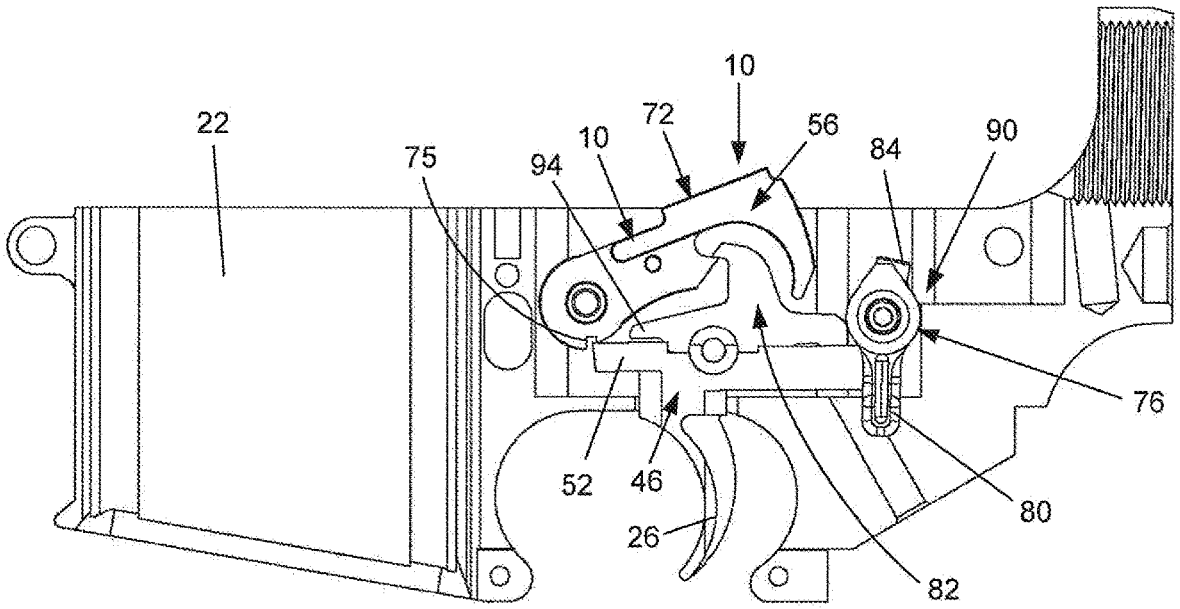
FIG. 25 is a left side view of the lower receiver of FIG. 24 showing the trigger having sprung forward after release by the operator's finger.

FIG. 20 shows the safety selector 76 having been moved to its safe position 88 by the operator of the firearm 12 having moved a switch lever 80 or 136 to provide the additional action required by the fire control lockout assembly 10 of the present invention. The protrusion 84 of the modified safety selector 76 has rotated with the movement of the selector switch lever 80/136 by the operator such that the protrusion 84 is pushing downward against the rearward segment 96 of the disconnector 82, which pressure releases the hammer 56 so the notch 75 of the hammer 56 will come in contact with and be engaged by the edge of the trigger sear 52. Although the hammer 56 is being engaged by the sear 52, the firearm 12 is still not able to be fired because the prior art hemicylindrical block design of the safety selector 76 prevents the trigger 26 from being moved (i.e., being squeezed by the operator). FIG. 21 shows the safety switch lever 80 having been moved by the operator of the firearm 12 to place the safety selector 76 back in its fire position 90 where a round may be fired from the firearm 12 by the operator pulling the trigger 26. FIG. 22 shows the trigger 26 having been pulled by the operator of the firearm 12, which pivots the trigger sear 52 and the first/forward end 68 of the disconnector 82 downward, just before the hammer 56 is released to strike a round that was previously chambered to its firing position. FIG. 23 shows the hammer 56 having been fully pivoted so the hammer face 72 will strike the firing pin of the chambered round. FIG. 24 shows the fire control lockout assembly 10 after the bolt carrier group has moved rearward to push the hammer 56 back to a position where the hammer hook 58 is caught by the disconnector hook 66. FIG. 25 shows fire control lockout assembly 10 after the operator of the firearm 12 has released his or her finger from the trigger 26, allowing the trigger spring 54 to pivot the trigger assembly 46 so the notch 75 near the first/forward end 60 of the hammer 56 is positioned near, but not engaged by, the trigger sear 52 of the trigger assembly 48, which (like FIG. 19) does not allow the operator to fire the firearm 12. Firing a subsequent round from the firearm 12 requires the operator to move the safety selector 76 back to its safe position 88 so the protrusion 84 thereof will press downward on the second/rearward end 70 of the disconnector 82 and then to its fire position 90, as described with regard to FIGS. 20-21. As will be readily appreciated by persons who are skilled in the relevant art, instead of operating as a semiautomatic weapon, the new fire control lockout assembly 10 cause the firearm 12 to be in a single shot operating mode, which provides the safety and functional benefits (including use of certain accessories) that are set forth herein.

Figure 27:
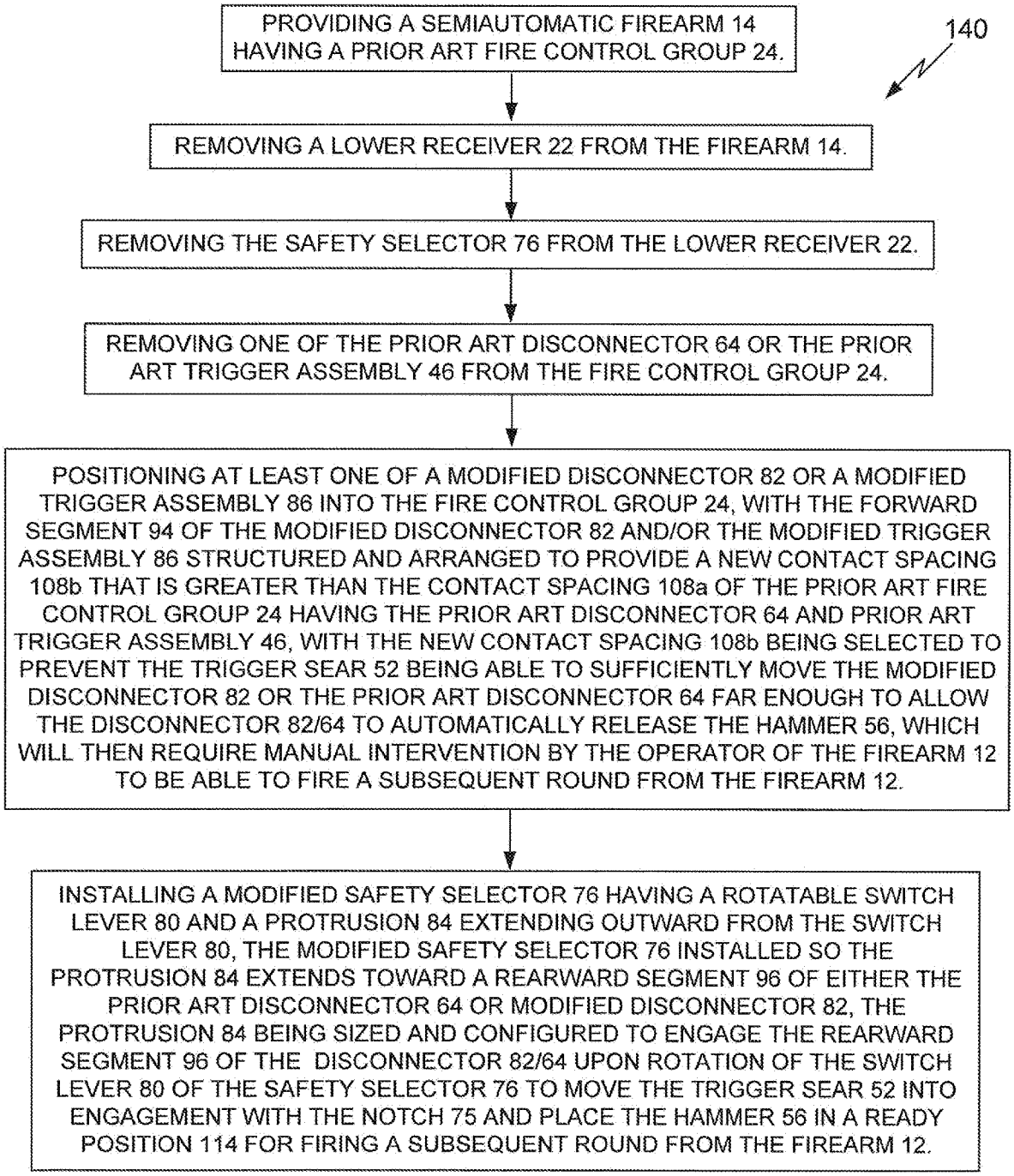
FIG. 27 is a method of converting the prior art semiautomatic firearm of FIG. 1 to the firearm of FIG. 7 having single shot operation.

As set forth above, the fire control lockout assembly 10 of the present invention can be included with a firearm 12 that is purchased by or on behalf of the operator of the firearm 12 or a prior art firearm 14 can be modified to incorporate the new fire control lockout assembly 10. With regard to the latter circumstance, a method of converting a prior art semiautomatic firearm 14, having the prior art fire control group 24 and prior art safety selector 76, to single shot operation is shown as 140 in FIG. 27. Initially, the user will separate the lower receiver 22 from the upper receiver 21 and the other "upper" components of the firearm 14. The user then will push out the retaining pin that holds the hammer 56 in the lower receiver 22 to remove the hammer 56 and hammer spring. The user will then remove the grip retaining bolt and slowly remove the grip, detent spring and the detent pin, while being careful not to lose the detent spring and the fire control safety selector detent pin. The fire control safety selector 76 is removed. The user then pushes the trigger retaining pin just past halfway out of the lower receiver 22 and removes the prior art disconnector 64 from the trigger assembly 46, making sure the disconnector spring stays in place, and for the second embodiment removes the trigger assembly 46. With prior art firearm 14 disassembled, the user installs the relevant components of the fire control lockout assembly 10 to convert the prior art semiautomatic firearm 14 to a firearm 12 having single shot operation. Specifically, the user installs either the modified disconnector 82, which has the removed area 116 described above, and/or the modified trigger assembly 86, having the removed area 132 described above, while making sure the disconnector spring is properly aligned. The trigger/disconnector retaining pin is pushed back into position centered in the lower receiver 22. The user installs the new safety selector 78, having the protrusion 84, into the lower receiver 22 and, preferably (but not required) attaches the second switch lever 136 on the opposite side of the lower receiver 22 from the original switch lever 80. The user then installs the hammer 56 and hammer spring by placing the components in position and then pushing the hammer retaining pin back into its center position in the lower receiver 22. When the method 140 of converting the firearm 14 is completed and the new fire control lockout assembly 10 is operational, the prior art semiautomatic firearm 14 will be converted to a firearm 12 having single shot operation, provided by the increased distance of the new contact spacing 108*b*, requiring certain manual action, namely two-step movement of the safety selector 76, by the operator prior to being able to fire a subsequent round from the firearm 12.

Figure 28:
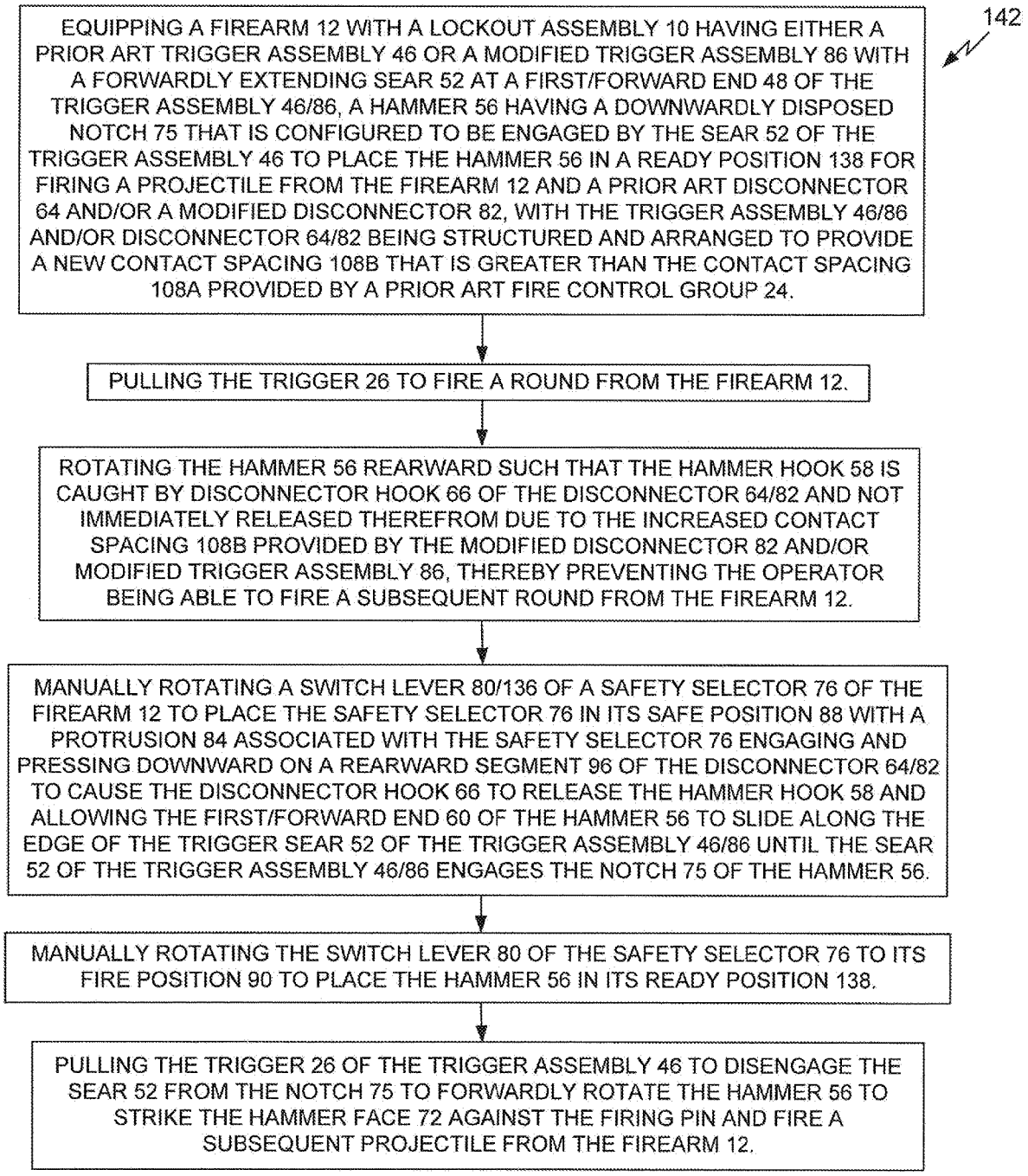
FIG. 28 is a method of operating the firearm of FIG. 7.

A method of operating a firearm for single shot operation with regard to the first embodiment described above is shown as 142 in FIG. 28. The method 122 comprises the steps of: (1) equipping a firearm 12 with a lockout assembly 10 having either a prior art trigger assembly 46 or a modified trigger assembly 86 with a forwardly extending sear 52 at a first/forward end 48 of the trigger assembly 46/86, a hammer 56 having a downwardly disposed notch 75 that is configured to be engaged by the sear 52 of the trigger assembly 46 to place the hammer 56 in a ready position 138 for firing a projectile from the firearm 12 and a prior art disconnector 64 and/or a modified disconnector 82, with the trigger assembly 46/86 and/or disconnector 64/82 being structured and arranged to provide a new contact spacing 108*b* that is greater than the contact spacing 108*a* provided by a prior art fire control group 24; (2) pulling the trigger 26 to fire a round from the firearm 12; (3) rotating the hammer 56 rearward such that the hammer hook 58 is caught by disconnector hook 66 of the disconnector 64/82 and not immediately released therefrom due to the increased contact spacing 108*b* provided by the modified disconnector 82 and/or modified trigger assembly 86, thereby preventing the operator being able to fire a subsequent round from the firearm 12; (4) manually rotating a switch lever 80/136 of a safety selector 76 of the firearm 12 to place the safety selector 76 in its safe position 88 with a protrusion 84 associated with the safety selector 76 engaging and pressing downward on a rearward segment 96 of the disconnector 64/82 to cause the disconnector hook 66 to release the hammer hook 58 and allowing the first/forward end 60 of the hammer 56 to slide along the edge of the trigger sear 52 of the trigger assembly 46/86 until the sear 52 of the trigger assembly 46/86 engages the notch 75 of the hammer 56; (5) manually rotating the switch lever 80 of the safety selector 76 to its fire position 90 to place the hammer 56 in its ready position 138; and (6) pulling the trigger 26 of the trigger assembly 46 to disengage the sear 52 from the notch 75 to forwardly rotate the hammer 56 to strike the hammer face 72 against the firing pin and fire a subsequent projectile from the firearm 12. As set forth above, the increased contact spacing 108*b* is provided by having a modified disconnector 82 with the forward segment 94 thereof being beneficially configured for the contact spacing 108*b* and/or having a removed area 116 that provides the contact spacing 108*b* or by having a modified trigger assembly 86 having a trigger sear 52 with a removed area 132 providing a lowered sear contact surface 130. In other embodiments, the increased contact spacing 108*b* can be provided by using both of a modified disconnector 82 and a modified trigger assembly 86, with the modifications being selected to provide the contact spacing 108*b*. The protrusion 84 is sized and configured to engage the rearward segment 96 of the disconnector 64/82 upon the first rotation of one of the switch levers 80/136 of the safety selector 76 so as to further move the trigger sear 52 into engagement with the disconnector 64/82 and then, upon a second rotation of one of the switch levers 80/136, to move the disconnector 64/82 far enough to release the hammer 56 to place the hammer 56 in its ready position 138. In the method 142 set forth above, the safe position 88 of the safety selector 76 prevents firing the firearm 12 and the fire position 90 of the safety selector 76 allows firing the firearm 12, and the increased contact spacing 108*b* is selected to prevent firing the firearm 12 until after the sequential rotation of the safety selector 76 to the safe position 88 and then to the fire position 90, which sequence engages the sear 52 of the trigger assembly 46 with the notch 75 of the hammer 56 to place the hammer in its ready position 138.

The benefit of the new fire control lockout assembly 10 of the present invention, with either the modified disconnector 82, having the removed area 116 (whether actually removed or not), or the modified trigger assembly 86, having the removed area 132, with the safety selector 76, having the protrusion 84, is that the semiautomatic action of an AR-15 or AK47 style rifle or the like is interrupted by the fire control lockout assembly 10 when a round has been fired from the firearm 12. After firing a round from the firearm 12 having the new lockout assembly 10, the increased contact spacing 108*b* resulting from the modified disconnector 82 and prior art trigger assembly 46 (first embodiment) or the prior art disconnector 64 and the modified trigger assembly 86 (second embodiment) causes the disconnector 82/64 to not be moved by the trigger sear 52 far enough to disengage the hammer 54 from the disconnector 82/64, which normally happens automatically when the operator pulls the trigger 26. The inability of the sear 52 at the first/forward end 48 of the trigger assembly 46 to sufficiently move the modified disconnector 82 or the modified trigger assembly 86 to sufficiently move the prior art disconnector 64 and slide the disconnector hook 66 off the hammer hook 58 is the interrupt provided by the fire control lockout assembly 10. This limiting of the firearm's fire control group action converts a semiautomatic firearm 14, such as an AR-15 or AK47 style rifle, into a single shot firearm 12. As a single shot firearm 12, the operator can only fire a subsequent round from the firearm 12 by returning the safety selector 76 of the firearm 12 to its safe position 88, which is accomplished by manually rotating the fire selector switch 80 or 136 back to the safe position 88, and then rotating the selector switch 80/136 to place the safety selector 76 back in its fire position 90, as set forth in more detail above. The new fire control lockout assembly 10 can be easily and quickly installed in a prior art semiautomatic firearm 14 to convert the firearm 14 to a firearm 12 having single shot operation or the new lockout assembly 10 can be incorporated into a firearm 12 that is purchased having a fire control lockout assembly 10 for single shot operation. In addition, as will be readily appreciated by persons who are skilled in the art, the fire control lockout assembly 10, with the modified safety selector 76 and either the modified disconnector 82 or the modified trigger assembly 86, described above can be adapted as necessary so as to be utilized with a wide variety of different types of semiautomatic firearms to convert the semiautomatic operation thereof to single shot operation to achieve the benefits set forth herein. Because the new fire control lockout assembly 10 is relatively inexpensive to manufacture, the benefits thereof should be generally widely available to persons who want to obtain the various benefits of having a firearm 12 with single shot operation.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor and to enable other persons who are skilled in the relevant art to be able to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. A fire control lockout assembly for use with a firearm for single shot operation of the firearm, said fire control lockout assembly comprising:

a trigger assembly having a forwardly extending sear positioned at a first end of said trigger assembly;

a hammer pivotally associated with said trigger assembly, said hammer cooperatively configured with said trigger assembly so as to be engaged by said sear to hold said hammer in a ready position for firing the firearm;

a disconnector pivotally associated with each of said trigger assembly and said hammer, said disconnector having a disconnector body with a forward segment at a first end and a rearward segment at a second end, said disconnector and said hammer cooperatively configured to engage each other to prevent said hammer from being placed in said ready position until said hammer is released from said disconnector, said sear and said disconnector being cooperatively configured with a contact spacing that prevents said sear from being able to push said forward segment of said disconnector far enough upward to disengage said hammer from disconnector; and a safety selector associated with said disconnector, said safety selector having a moveable switch lever to move said safety selector between a safe position preventing the firearm from being fired and a fire position allowing the firearm to be fired and a barrel connected to said switch lever so as to be moved by movement of said switch lever, said barrel being sized and configured to engage said rearward segment of said disconnector upon movement of said switch lever to said safe position so as to release said hammer from said disconnector and place said hammer in said ready position to allow said firearm to be fired after movement of said switch lever to said fire position.

2. The lockout assembly of claim 1, wherein said trigger assembly has a downwardly extending trigger, the firearm configured to be fired when said hammer is in said ready position and said switch lever is in said fire position upon rearward movement of said trigger causing said sear to release said hammer.

3. The lockout assembly of claim 1, wherein said hammer has a notch at or near a first end of said hammer, said notch and said sear cooperatively configured so said notch is engaged by said sear to hold said hammer in said ready position, the firearm to be fired when said sear is disengaged from said notch of said hammer.

4. The lockout assembly of claim 1, wherein said hammer has a downwardly extending hammer hook disposed between a first end and a second end of said hammer and said disconnector has an upwardly disposed disconnector hook disposed between said first end and said second end of said disconnector body, said hammer hook and said disconnector hook being cooperatively configured so as to engage each other prior to placement of said hammer in said ready position.

5. The lockout assembly of claim 4, wherein said barrel of said safety selector is sized and configured to push downward on said rearward segment of said disconnector when said switch lever is moved to said safe position to release said hammer hook from said disconnector hook to allow said sear of said trigger assembly to engage said hammer and place said hammer in said ready position.

6. The lockout assembly of claim 5, wherein said safety selector has a protrusion extending outward from said barrel, said protrusion being sized and configured to push downward on said rearward segment of said disconnector when said switch lever is moved to said safe position to release said hammer hook from said disconnector hook.

7. The lockout assembly of claim 1, wherein said barrel of said safety selector is sized and configured to push downward on said rearward segment of said disconnector when said switch lever is moved to said safe position to release said hammer from said disconnector to place said hammer in said ready position.

8. The lockout assembly of claim 7, wherein said safety selector has a protrusion extending outwardly from said barrel, said protrusion being sized and configured to engage said rearward segment of said disconnector when said switch lever is moved to said safe position to release said hammer from said disconnector and place the firearm in said ready position with said hammer engaged by said sear so the firearm may be fired when said safety selector is in said fire position.

9. The lockout assembly of claim 8, wherein said disconnector and said barrel of said safety selector are cooperatively configured for said protrusion to push downward on said rearward segment when said safety selector is moved to said safe position and cause said disconnector to release said hammer.

10. The lockout assembly of claim 1, wherein at least one of said forward segment of said disconnector and a trigger body of said trigger assembly is sized and configured to provide said contact spacing, which requires manual movement of said safety selector to said safe position so said barrel of said safety selector will engage said rearward segment of said disconnector in order to place said hammer in said ready position and then movement of said safety selector to said fire position to fire the firearm.

11. The lockout assembly of claim 10, wherein said at least one of said forward segment and said trigger body has a removed area with a depth selected to provide said contact spacing, which prevents release of said hammer from said disconnector upon upward movement of said sear.

12. A method of operating a firearm for single shot operation, said method comprising the steps of:

a) equipping the firearm with a fire control lockout assembly having a trigger assembly with trigger body having a sear at a first end thereof, a hammer configured to be engaged by said sear to hold said hammer in a ready position for firing the firearm, a disconnector with a disconnector body having a forward segment at a first end thereof and a rearward segment at a second end thereof and a safety selector with a moveable switch lever and a barrel connected to said switch lever so as to move therewith, at least one of said forward segment of said disconnector and said trigger body of said trigger assembly being sized and configured so as to provide a contact spacing that requires manual movement of said safety selector to said safe position in order to place said hammer in said ready position;

b) engaging said hammer with said disconnector so as to prevent said hammer from being moved into said ready position;

c) releasing said hammer from said disconnector by manually moving said switch lever to place said safety selector in said safe position and press said barrel downward on said rearward segment of said disconnector to allow said sear to engage said hammer and hold said hammer in said ready position;

d) moving said switch lever to a fire position; and e) firing the firearm by pulling a trigger of said trigger assembly to disengage said sear from said hammer so as to pivot said hammer.

13. The method of claim 12, wherein said at least one of said forward segment of said disconnector and said trigger body of said trigger assembly has a removed area with a depth that is selected to provide said contact spacing, which prevents release of said hammer from said disconnector until movement of said safety selector to said safe position that presses said barrel downward on said rearward segment of said disconnector.

14. The method of claim 12, wherein said safety selector has a protrusion extending outwardly from said barrel, said protrusion being sized and configured to engage said rearward segment of said disconnector when said switch lever is moved to said safe position to release said hammer from said disconnector and place the firearm in said ready position with said hammer engaged by said sear so the firearm may be fired after said safety selector is moved to said fire position.

15. The method of claim 12, wherein said engaging step is accomplished by a downwardly extending hammer hook of said hammer engaging an upwardly disposed disconnector hook of said disconnector body and said releasing step is accomplished by said barrel pressing downward on said rearward segment to release said hammer hook from said disconnector hook.

16. The method of claim 15, wherein said hammer has a notch sized and configured to be engaged by said sear, said firing step accomplished by said sear disengaging from said notch.

17. A method of converting a semiautomatic firearm having a fire control group and a safety selector to single shot operation, said method comprising the steps of:

a) removing the safety selector from the firearm;

b) separating at least one of a disconnector and a trigger assembly from the fire control group, said disconnector having a forward segment and said trigger assembly having a sear with a sear contact surface at an upper surface of said sear, said forward segment of said disconnector and said sear contact surface of said trigger assembly defining a first contact spacing therebetween;

c) positioning at least one of a modified disconnector and a modified trigger assembly into the fire control group in the firearm, said at least one of said modified disconnector and said modified trigger assembly selected to provide a new contact spacing that is greater than the first contact spacing, said new contact spacing being selected so as to prevent upward movement of said sear from moving a forward segment of one of said disconnector and said modified disconnector sufficiently upward enough to release said hammer from said disconnector in order to prevent placing said hammer in a ready position that would allow firing the firearm; and d) installing a modified safety selector having a moveable switch lever and a barrel connected to said switch lever so as to move therewith, said modified safety selector installed so said barrel thereof will engage a rearward segment of either said disconnector or said modified disconnector and press down on said rearward segment upon movement of said switch lever of said safety selector to a safe position to release said hammer from engagement with said one of said disconnector and said modified disconnector and place said hammer in said ready position.

18. The method of claim 17, wherein at least one of a forward segment of said modified disconnector and a trigger body of said modified trigger assembly has a removed area with a depth that is selected to provide said new contact spacing and prevent release of said hammer from said one of said disconnector and said modified disconnector until movement of said safety selector that presses said barrel of said safety selector downward on said rearward segment of said one of said disconnector and said modified disconnector.

19. The method of claim 17, wherein said modified safety selector has a protrusion extending outwardly from said barrel, said protrusion being sized and configured to press downward on said rearward segment of said one of said disconnector and said modified disconnector when said switch lever is moved to said safe position in order to release said hammer and place the firearm in said ready position with said hammer engaged by said sear.

20. The method of claim 17, wherein a downwardly extending hammer hook of said hammer engages an upwardly disposed disconnector hook of said one of said disconnector and said modified disconnector and said modified safety selector is structured and arranged to release said hammer hook from said disconnector hook upon pressing downward on said rearward segment of said one of said disconnector and said modified disconnector by movement of said modified safety selector to said safe position.

* * * * *